US008760244B2

(12) United States Patent
Kawai et al.

(10) Patent No.: US 8,760,244 B2
(45) Date of Patent: Jun. 24, 2014

(54) MULTIROLE CIRCUIT ELEMENT CAPABLE OF OPERATING AS VARIABLE RESONATOR OR TRANSMISSION LINE AND VARIABLE FILTER INCORPORATING THE SAME

(75) Inventors: Kunihiro Kawai, Yokohama (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 480 days.

(21) Appl. No.: 13/040,717

(22) Filed: Mar. 4, 2011

(65) Prior Publication Data

US 2011/0215886 A1 Sep. 8, 2011

(30) Foreign Application Priority Data

Mar. 5, 2010 (JP) ..... 2010-049126

(51) Int. Cl.

| | |
|---|---|
| ***H01P 7/00*** | (2006.01) |
| ***H01P 1/203*** | (2006.01) |
| ***H01P 5/00*** | (2006.01) |
| ***H01P 1/12*** | (2006.01) |

(52) U.S. Cl.

CPC *H01P 7/00* (2013.01); *H01P 1/203* (2013.01); *H01P 5/00* (2013.01); *H01P 1/127* (2013.01)

USPC ..... 333/219; 333/205; 333/245; 333/262

(58) Field of Classification Search

CPC ..... H01P 7/00; H01P 1/203; H01P 5/00; H01P 1/127

USPC ..... 333/101, 104, 105, 125, 204, 205, 219, 333/236, 245, 262

See application file for complete search history.

(56) References Cited

U.S. PATENT DOCUMENTS 3,883,828 A * 5/1975 Cappucci ..... 333/116
4,697,160 A * 9/1987 Clark ..... 333/103

(Continued)

FOREIGN PATENT DOCUMENTS

JP 55-104103 8/1980
JP 5-327322 12/1993

(Continued)

OTHER PUBLICATIONS

Extended Search Report issued Jun. 1, 2011 in Japan Application No. 11156817.6.

(Continued)

*Primary Examiner* — Benny Lee
*Assistant Examiner* — Rakesh Patel
(74) *Attorney, Agent, or Firm* — Oblon, Spivak, McClelland, Maier & Neustadt, L.L.P.

(57) ABSTRACT

A variable resonator includes a first transmission line 101, a second transmission line 102 and a plurality of switch circuits 150. The electrical length of the first transmission line 101 is equal to the electrical length of the second transmission line 102. The characteristic impedance for the even mode of the first transmission line 101 is equal to the characteristic impedance for the even mode of the second transmission line 102. The characteristic impedance for the odd mode of the first transmission line 101 is equal to the characteristic impedance for the odd mode of the second transmission line 102. Each switch circuit 150 is connected to any of the first transmission line 101 and the second transmission line 102, and one of the switch circuits 150 is turned on.

21 Claims, 27 Drawing Sheets

(56) References Cited

U.S. PATENT DOCUMENTS

| | | | |
|---|---|---|---|
| 5,162,759 | A | 11/1992 | Yajima |
| 7,135,940 | B2 | 11/2006 | Kawakubo et al. |
| 7,292,124 | B2 | 11/2007 | Kawai et al. |
| 7,583,168 | B2 | 9/2009 | Kawai et al. |
| 2003/0025563 | A1 | 2/2003 | Christensen |

FOREIGN PATENT DOCUMENTS

| | | |
|---|---|---|
| JP | 2001-230602 | 8/2001 |
| JP | 2004-7352 | 1/2004 |
| JP | 2005-217852 | 8/2005 |
| JP | 2009-71343 | 4/2009 |

OTHER PUBLICATIONS

Korean Office Action issued Jun. 12, 2012, in Korea Patent Application No. 10-2011-0018451 (with English Translation).
Extended Search Report issued Jun. 1, 2011 in European Application No. 11156817.6.
Office Action issued Dec. 20, 2011, in Japanese Patent Application No. 2010-049126 (with English-language translation).
Hong-Teuk Kim, et al., "Low-Loss and Compact V-Band MEMS-Based Analog Tunable Bandpass Filters", IEEE Microwave and Wireless Components Letters, vol. 12, No. 11, Nov. 2002, pp. 432-434.
E. Fourn, et al., "Bandwidth and Central Frequency Control on Tunable Bandpass Filter by Using MEMS Cantilevers", IEEE MTT-S Digest, 2003, pp. 523-526.
Arnaud Pothier, et al., "Low-Loss 2-Bit Tunable Bandpass Filters Using MEMS DC Contact Switches", IEEE Transactions on Microwave Theory and Techniques, vol. 53, No. 1, Jan. 2005, pp. 354-360.
Bruce E. Carey-Smith, "Wide Tuning-Range Planar Filters Using Lumped-Distributed Coupled Resonators", IEEE Transactions on Microwave Theory and Techniques, vol. 53, No. 2, Feb. 2005, pp. 777-785.
Kamran Entesari, et al., "A Differential 4-bit 6.5-10-GHz RF MEMS Tunable Filter", IEEE Transactions on Microwave Theory and Techniques, vol. 53, No. 3, Mar. 3, 2005, pp. 1103-1110.
Kamran Entesari, et al., "A 12-18-GHz Three-Pole RF MEMS Tunable Filter", IEEE Transactions on Microwave Theory and Techniques, vol. 53, No. 8, Aug. 2005, pp. 2566-2571.
Lung-Hwa Hsieh, et al., "Slow-Wave Bandpass Filters Using Ring or Stepped Impedance Hairpin Resonators", IEEE Transactions on Microwave Theory and Techniques, vol. 50, No. 7, Jul. 2002, pp. 1795-1800.
Kunihiro Kawai, et al., "Tunable Resonator Employing Comb-Shaped Transmission Line and Switches", Proceedings of the 35th European Microwave Conference, Oct. 2005, 5 pages.
Arun Chandra Kundu, et al., "Attenuation Pole Frequency Control of a Dual-Mode Circular Microstrip Ring Resonator BPF", Proceedings of the 29th European Microwave Conference, Oct. 1999, pp. 329-332.
Kunihiro Kawai, et al., "Tunable Band-pass Filter Employing Comb-shaped Transmission Line Resonator" Electronics Society Conference of the Institute of Electronics, Information and Communication Engineers, C-2-37, 2005, 4 pages (with Full English Translation).
Kunihiro Kawai, et al., "Center-frequency and Bandwidth Tunable Band-pass Filter Employing Comb-shaped Transmission Line Resonator", General Conference of the Institute of Electronics, Information and Communication Engineers, C-2-35, 2006, 4 pages (with Full English Translation).
Kunihiro Kawai, et al., "Center Frequency and Bandwidth Tunable Filter Employing Tunable Comb-Shaped Transmission Line Resonators and J-inverters", Proceedings of the 36th European Microwave Conference, Sep. 2006, pp. 649-652.
Kunihiro Kawai, et al., "Comb-shaped Transmission Line Tunable Resonator Employing MEMS RF Switches", Electronics Society Conference of the Institute of Electronics, Information and Communication Engineers, C-2-77, 2006, 4 pages (with Full English translation).
S. H. Al-Charchafchi, et al., "Varactor tuned microstrip ring resonators", IEE Proceedings, vol. 136, Pt. H, No. 2, Apr. 1989, pp. 165-168.
T. Scott Martin, et al., "Electronically Tunable and Switchable Filters Using Microstrip Ring Resonators Circuits", IEEE MTT-S Digest, 1988, pp. 803-806.
P. Gardner, et al., "Microwave voltage tuned microstrip ring resonator oscillator", Electronics Letters, vol. 30, No. 21, Oct. 13, 1994, pp. 1770-1771.
Michiaki Matsuo, et al., "Dual-Mode Stepped-Impedance Ring Resonator for Bandpass Filter Applications" IEEE Transactions on Microwave Theory and Techniques, vol. 49, No. 7, Jul. 2001, pp. 1235-1240.
Hitoshi Ishida, et al., "A design of tunable UWB filters", IEEE International Workshop on Ultra Wideband Systems, May 2004, pp. 424-428.
Kouki Saitou, et al., "Tunable Duplexer Having Multilayer Structure Using LTCC", IEEE MTT-S Digest, 2003, pp. 1763-1766.
F. A. Miranda, et al., "A K-Band (HTS, Gold)/Ferroelectric Thin Film/Dielectric Diplexer for a Discriminator-Locked Tunable Oscillator", IEEE Transactions on Applied Superconductivity, vol. 9, No. 2, Jun. 1999, pp. 3581-3584.
Kunihiro Kawai, et al., "Ring Resonators for Bandwidth and Center Frequency Tunable Filter", Proceedings of the 37th European Microwave Conference, Oct. 2007, pp. 298-301.
Kunihiro Kawai, et al., "Tunable Ring Resonator Filter for Duplexer", Proceedings of the 38th European Microwave Conference, Oct. 2008, pp. 603-606.
Kunihiro Kawai, et al., "Center Frequency, Bandwidth, and Transfer Function Tunable Bandpass Filter Using Ring Resonator and J-inverter", Proceedings of the 39th European Microwave Conference, Sep. 29 to Oct. 1, 2009, pp. 1207-1210.
Dimitrios Peroulis, et al., "Tunable Lumped Components with Applications to Reconfigurable MEMS Filters," IEEE MTT-S Digest, pp. 341-344, Copyright 2001.
Lei Zhu, et al., "A Joint Field/Circuit Design Model of Microstrip Ring Dual-Mode Filter: Theory and Experiments", Asia Pacific Microwave Conference, pp. 865-868, Copyright 1997.
Kunihiro Kawai, et al., "Reconfigurable Microwave-Band Bandpass Filter", IEEE International Conference on Wireless Information Technology and Systems, 5 pages, Copyright 2010.

* cited by examiner

MULTIROLE CIRCUIT ELEMENT CAPABLE OF OPERATING AS VARIABLE RESONATOR OR TRANSMISSION LINE AND VARIABLE FILTER INCORPORATING THE SAME

TECHNICAL FIELD

The present invention relates to a multirole circuit element capable of operating as a variable resonator or a transmission line used in a high-frequency circuit and to a variable filter incorporating the same.

BACKGROUND ART

In the high-frequency radio communication technology, a circuit called a filter is used to separate various signals into necessary signals and unnecessary signals by allowing signals at predetermined frequencies to pass through the filter and blocking other signals. In general, a filter has a fixed central frequency and a fixed bandwidth as design parameters.

Filters are used in various types of radio communication devices. In order for a radio communication device to function at various frequencies and with various bandwidths, a filtering function has to be provided at various central frequencies and with various bandwidths. A possible method to achieve this is to use a switch to switch among a plurality of filters having different combinations of central frequency and bandwidth that are conventionally mounted in the device. According to this method, the same number of filters are needed as the number of the combinations of central frequency and bandwidth, so that the circuit size increases. As a result, the device becomes large. In addition, according to this method, the radio communication device cannot serve the function under conditions other than the combinations of central frequency and bandwidth of the conventionally mounted filters.

To solve the problems, according to a technique disclosed in Japanese Patent Application Laid-Open No. 2004-7352 (referred to as Patent literature 1 hereinafter), a piezoelectric element is used in a resonator in the filter, and a bias voltage is externally applied to the piezoelectric element to change the frequency characteristics (resonance frequency) of the piezoelectric element, thereby changing the bandwidth of the filter.

According to a technique disclosed in T. Scott Martin, Fuchen Wang and Kai Chang, "ELECTRONICALLY TUNABLE AND SWITCHABLE FILTERS USING MICROSTRIP RING RESONATOR CIRCUITS", IEEE MTT-S Digest, 1988, pp. 803-806 (referred to as Non-patent literature 1 hereinafter), a resonator is used that comprises two microstrip lines arranged in a ring with the ends of one opposed to and connected by a PIN diode to the ends of the other to provide a filter capable of changing the central frequency.

The variable filter disclosed in Patent literature 1 has a bandwidth of a ladder filter. However, the extent to which the central frequency of the filter can be changed is as small as about 1% to 2% because of the limitation by the characteristics of the piezoelectric element, and thus, the bandwidth can be changed only to similar extent and cannot be substantially changed.

The filter disclosed in Non-patent literature 1 can change the central frequency but cannot substantially change the bandwidth.

In addition, according to the prior art, circuit elements (such as a resonator and a filter) in a circuit have their respective fixed roles, and it is difficult to make the whole or some of the circuit elements function as components (such as a transmission line) other than themselves.

DISCLOSURE OF THE INVENTION

In view of such circumstances, objects of the present invention are to provide a multirole circuit element having a simple configuration, to provide a variable resonator and a variable filter that have a simple configuration and are capable of substantially changing the bandwidth, and to provide a variable resonator and a variable filter that are capable of substantially changing the bandwidth and changing the resonance frequency (the central frequency in the case of the filter) arbitrarily and independently of the bandwidth.

A multirole circuit element according to the present invention comprises: a first transmission line connected at one end thereof to an input line and at another end to an output line; a second transmission line having an electrical length equal to an electrical length of the first transmission line connected at one end thereof to the input line and at another end to the output line; and one or more switch circuits, wherein a characteristic impedance for an even mode and a characteristic impedance for an odd mode of the first transmission line are uniform in a length direction of the first transmission line, a characteristic impedance for an even mode and a characteristic impedance for an odd mode of the second transmission line are uniform in a length direction of the second transmission line, the characteristic impedance for the even mode of the first transmission line is equal to the characteristic impedance for the even mode of the second transmission line, the characteristic impedance for the odd mode of the first transmission line is equal to the characteristic impedance for the odd mode of the second transmission line, and each of the switch circuits is connected to any of the first transmission line and the second transmission line and is capable of selectively operating as any of at least a resonator and a transmission line depending on an on/off state of the switch circuits.

The multirole circuit element may comprise a plurality of switch circuits and may be configured to be capable of operating as a variable resonator capable of changing a bandwidth when one of the switch circuits is selectively turned on.

Provided that reference character R represents a predetermined integer equal to or greater than 1, and reference character r represents an integer equal to or greater than 1 and equal to or smaller than R, the multirole circuit element may further comprise R switches $S_r$, where r=1, 2, . . . , R, an r-th switch $S_r$ may be connected at one end thereof to the first transmission line and at another end to the second transmission, and an electrical length between the point of connection of the one end of the switch $S_r$ to the first transmission line and the one end of the first transmission line may be equal to an electrical length between the point of connection of the other end of the switch $S_r$ to the second transmission line and the one end of the second transmission line.

The multirole circuit element may comprise a plurality of switch circuits and may be configured to be capable of operating as a variable resonator capable of changing a bandwidth when one of the switch circuits is selectively turned on.

A variable filter may be formed by providing a plurality of multirole circuit elements described above and connecting a K-inverter in series between adjacent two of the multirole circuit elements.

Alternatively, a variable filter according to the present invention may comprise a first transmission line connected at one end thereof to an input line and at another end to an output line, a second transmission line having an electrical length equal to an electrical length of the first transmission line connected at one end thereof to the input line and at another end to the output line, and one or more switch circuits, a characteristic impedance for an even mode and a characteristic impedance for an odd mode of the first transmission line may be uniform in a length direction of the first transmission line, a characteristic impedance for an even mode and a characteristic impedance for an odd mode of the second transmission line may be uniform in a length direction of the second transmission line, the characteristic impedance for the even mode of the first transmission line may be equal to the characteristic impedance for the even mode of the second transmission line, the characteristic impedance for the odd mode of the first transmission line may be equal to the characteristic impedance for the odd mode of the second transmission line, each of the switch circuits may be connected to any of the first transmission line and the second transmission line, provided that reference character R represents a predetermined integer equal to or greater than 2, and r=1, 2, . . . , R, an r-th switch $S_r$ may be connected at one end thereof to the first transmission line and at another end to the second transmission line, and an electrical length between the point of connection of the one end of each of the switches $S_r$ to the first transmission line and the one end of the first transmission line may be equal to an electrical length between the point of connection of the other end of the switch $S_r$ to the second transmission line and the one end of the second transmission line, depending on the positions of two or more of the switches $S_r$ that are turned on, at least a part of the transmission lines may include two or more sections having a line length of a half wavelength at a same operating frequency and one or more sections having a line length of a quarter wavelength or an integral multiple thereof at the operating frequency that are alternately arranged in the length direction, and the number of switch circuits turned on in each of the sections having a line length of a half wavelength may be one, and the number of switch circuits turned on in each of the sections having a line length of a quarter wavelength or an integral multiple thereof may be zero.

Effects of the Invention

The multirole circuit element according to the present invention can function as a transmission line and a variable resonator (or a variable filter) depending on the selective setting of the on/off state of the switch circuits. The variable resonator according to the present invention can substantially change the bandwidth by selecting one of a plurality of switch circuits to be turned on. A variable filter capable of substantially changing the bandwidth can be provided by using the variable resonator. In the case where the variable resonator has a switch that links the two transmission lines to each other, the resonance frequency can be arbitrarily changed independently of the bandwidth by selectively turning on and off the switch. A variable filter not only capable of substantially changing the bandwidth but also capable of arbitrarily changing the central frequency independently of the bandwidth, can be provided by using the variable resonator. In the case where the variable filter has a plurality of switches that link the two transmission lines to each other, not only the bandwidth and the central frequency but also the number of stages of the filter can be independently changed by appropriately selecting the switches to be turned on.

BRIEF DESCRIPTION OF THE DRAWINGS

FIG. 13B shows the variable resonator shown in FIG. 11A in which one of a plurality of switches between the transmission lines is turned on;

FIG. 13C shows the variable resonator shown in FIG. 11A in which two of the plurality of switches between the transmission lines are turned on;

FIG. 14 shows the variable resonator shown in FIG. 13A in which a plurality of switches between the transmission lines are turned on;

FIG. 15A is a graph illustrating that an unwanted resonance occurs when a switch around the center of the two transmission lines is turned on;

DETAILED DESCRIPTION OF THE EMBODIMENTS

Figure 1A:
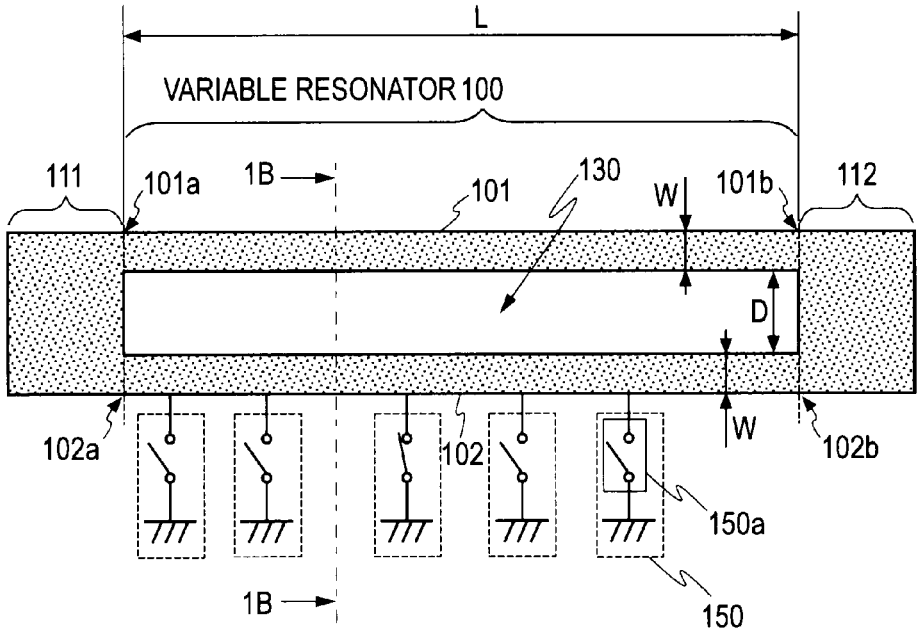
FIG. 1A is a plan view of a variable resonator capable of changing a bandwidth according to the present invention.
Figure 1B:
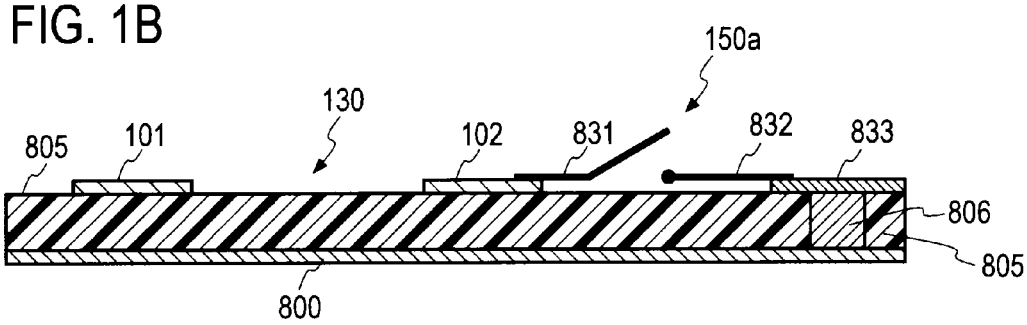
FIG. 1B is a cross-sectional view of the variable resonator shown in FIG. 1A taken along the line 1B-1B.

FIG. 1A shows a variable resonator 100 having a microstrip line structure according to an embodiment of the present invention, and FIG. 1B is a cross-sectional view of the variable resonator 100 taken along the line 1B-1B. The variable resonator 100 comprises two transmission lines 101 and 102 and a plurality of switch circuits 150. In the embodiment shown in FIG. 1A, the two transmission lines 101 and 102 having a rectangular shape are formed on a dielectric substrate 805. The first transmission line 101 is connected at one end 101*a* thereof to an input line 111 formed on the dielectric substrate 805 and at the other end 101*b* to an output line 112 formed on the dielectric substrate 805. The second transmission line 102 is connected at one end 102*a* thereof to the input line 111 and at the other end 102*b* to the output line 112. The two transmission lines 101 and 102 are made of a conductor, such as metal, and formed on the top surface of the dielectric substrate 805. A grounding conductor 800 made of a conductor, such as metal, is formed on the opposite surface (back surface) of the dielectric substrate 805. A gap region defined by the two transmission lines 101 and 102, the input line 111 and the output line 112, which is denoted by reference numeral 130, is an exposed part of the dielectric substrate 805.

The two transmission lines 101 and 102 are required to meet the following conditions:

(1) the electrical length of the first transmission line 101 is equal to the electrical length of the second transmission line 102;

(2) the characteristic impedance for the even mode and the characteristic impedance for the odd mode of the first transmission line 101 are uniform in the length direction of the first transmission line 101;

(3) the characteristic impedance for the even mode and the characteristic impedance for the odd mode of the second transmission line 102 are uniform in the length direction of the second transmission line 102;

(4) the characteristic impedance for the even mode of the first transmission line 101 is equal to the characteristic impedance for the even mode of the second transmission line 102; and (5) the characteristic impedance for the odd mode of the first transmission line 101 is equal to the characteristic impedance for the odd mode of the second transmission line 102.

For example, if the dielectric substrate 805 has a uniform thickness and a uniform dielectric constant over the entire surface, the two transmission lines 101 and 102 meet the conditions (1) to (5) when the two transmission lines 101 and 102 are formed to have the following characteristics:

(a) the line length of the first transmission line 101 is equal to the line length of the second transmission line 102;

(b) the line width of the first transmission line 101 is equal to the line width of the second transmission line 102; and (c) the distance (denoted by reference character D in FIG. 1A) between the first transmission line 101 and the second transmission line 102 is fixed.

For the variable resonator 100 shown in FIG. 1, on the assumption that the dielectric substrate 805 has a uniform thickness and a uniform dielectric constant over the entire surface, the two transmission lines 101 and 102 have a line length L and a line width W and are formed on the dielectric substrate 805 on the opposite sides of the gap region 130 in parallel with each other at a distance D from each other.

In the case where the dielectric substrate 805 does not have a uniform thickness and/or a uniform dielectric constant, the two transmission lines 101 and 102 can be formed to meet the conditions (1) to (5) by considering the dielectric constant distribution or the like. The designing method therefore is implemented by well-known techniques and therefore will not be described in detail herein.

The variable resonator 100 shown in FIG. 1A has five switch circuits 150 (the reference numeral is affixed to only one of the switch circuits for the sake of clarity of the drawing). Although all the switch circuits 150 are connected only to the second transmission line 102 in the variable resonator 100, the present invention is not limited to this configuration, and the switch circuits 150 have only to be connected to either the first transmission line 101 or the second transmission line 102. Specific examples of the configuration of the switch circuit 150 will be described later. In the example shown in FIG. 1A, each switch circuit 150 has a switch 150*a* that is connected at one end thereof to either the first transmission line 101 or the second transmission line 102 and is grounded at the other end. As shown in FIG. 1B, each switch 150*a* is connected to the second transmission line 102 at one end 831 and is electrically connected to the grounding conductor 800 at the other end 832 via a conductor 833 and a via hole 806. There are no restrictions on the shape and other characteristics of the conductor 833, and therefore, illustration of the conductor 833 is omitted in the other drawings.

The switch circuits 150 are connected to the first transmission line 101 or the second transmission line 102 so as to meet the following conditions: [1] the electrical length from the one end 101*a* of the first transmission line 101 to the point of connection of each switch circuit 150 to the first transmission line 101 differs (note that the points of connection of the switch circuits 150 to the first transmission line 101 exclude the one end 101*a* and the other end 101*b*); and [2] the electrical length from the one end 102*a* of the second transmission line 102 to the point of connection of each switch circuit 150 to the second transmission line 102 differs (note that the points of connection of the switch circuits 150 to the second transmission line 102 exclude the one end 102*a* and the other end 102*b*). With such a configuration, the electrical length $\theta_1$ from the point of connection of a switch circuit to the first transmission line 101 to the one end 101*a* can be equal to the electrical length $\theta_2$ from the point of connection of a switch circuit to the second transmission line 102 to the one end 102*a*. If $\theta_1=\theta_2$, the switch circuit connected to the first transmission line 101 at the point of the electrical length $\theta_1$ from the one end 101*a* and the switch circuit connected to the second transmission line 102 at the point of the electrical length $\theta_2$ from the one end 102*a* have to be prevented from being turned on at the same time. As described later, in the case where the variable resonator 100 performs a resonant operation, only one of the switch circuits 150 is turned on. Considering this fact, it is useless to have switch circuits 150 connected to the first transmission line 101 and the second transmission line 102 at points of an equal electrical length from the input line 111. Therefore, in addition to the conditions [1] and [2] as to the point of connection of each switch circuit 150, there can be imposed another requirement: [3] the electrical length from each switch circuit 150 connected to one of the two transmission lines 101 and 102 to one end of the transmission line does not agree with the electrical length from any switch circuit 150 connected to the other transmission line to one end of the transmission line.

When one of the switch circuits 150 is turned on, the variable resonator 100 has a bandwidth corresponding to the point of connection of the switch circuit. When another of the switch circuits 150 is turned on, the variable resonator 100 has another bandwidth corresponding to the point of connection of the switch circuit. Therefore, the bandwidth of the variable resonator 100 can be changed by changing the switch to be turned on. This will be described with reference to a result of circuit simulation performed by using a model shown in FIG. 2.

Figure 2:
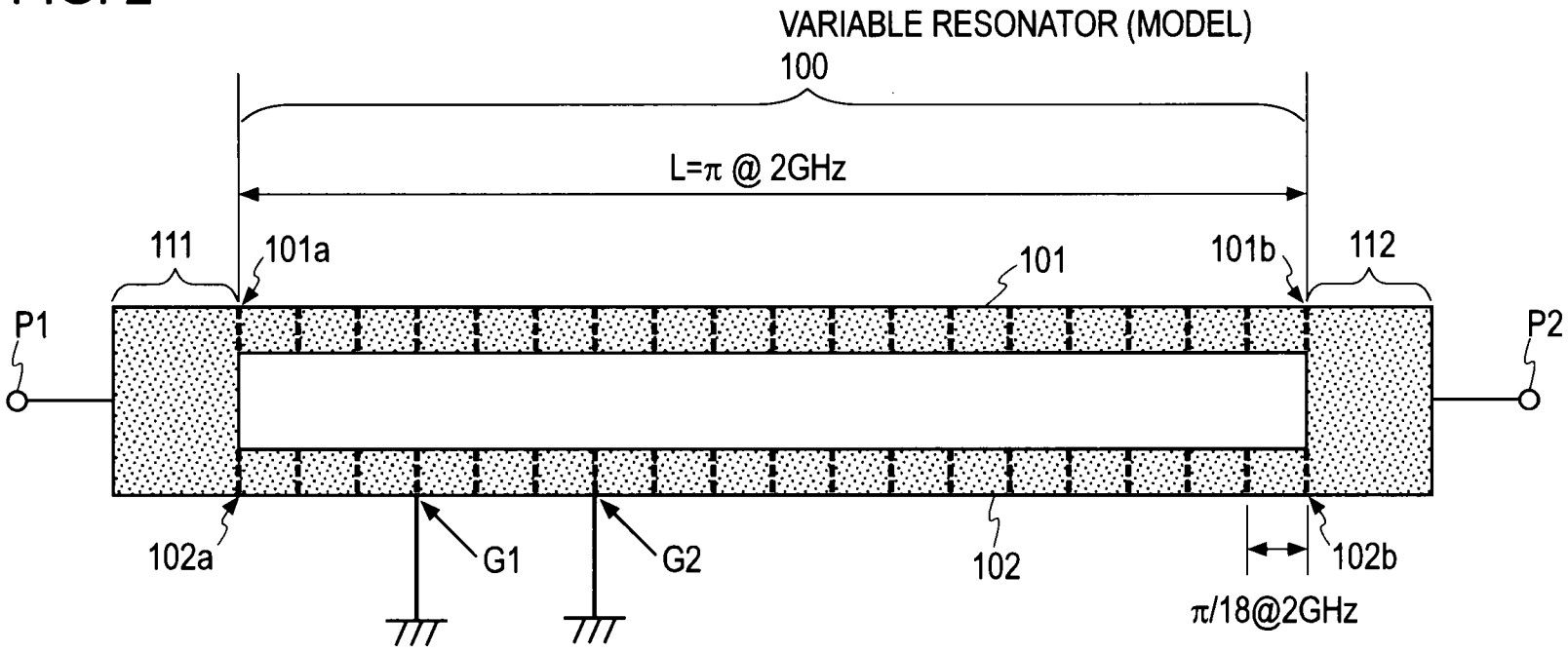
FIG. 2 is a diagram showing a model of the variable resonator shown in FIG. 1A used for circuit simulation.

FIG. 2 shows a simulation model of the variable resonator 100 shown in FIG. 1A using ideal transmission lines. It is assumed that the two parallel transmission lines 101 and 102 have a line length L of a half wavelength at 2 GHz (equivalent to an electrical length of 180° or π rad). Therefore, the variable resonator 100 resonates at 2 GHz. The expression "π@2 GHz" in the drawing means that the electrical length at 2 GHz is π rad, and similar expression will also be used in the other drawings.

It is assumed that the two transmission lines 101 and 102 are electromagnetically coupled to each other, the characteristic impedance for the even mode of the first transmission line 101 is 100Ω, the characteristic impedance for the odd mode of the first transmission line is 50Ω, the characteristic impedance for the even mode of the second transmission line 102 is 100Ω, and the characteristic impedance for the odd mode of the second transmission line 102 is 50Ω. In the case where the transmission lines having such characteristics are arranged to form a microstrip line on the dielectric substrate 805 having a dielectric constant of 9.5 and a substrate thickness of 0.5 mm, the two transmission lines 101 and 102 have a line width W of about 0.2 mm and a line length L of about 30 mm and are placed at a distance D of about 0.2 mm from each other.

Figure 3A:
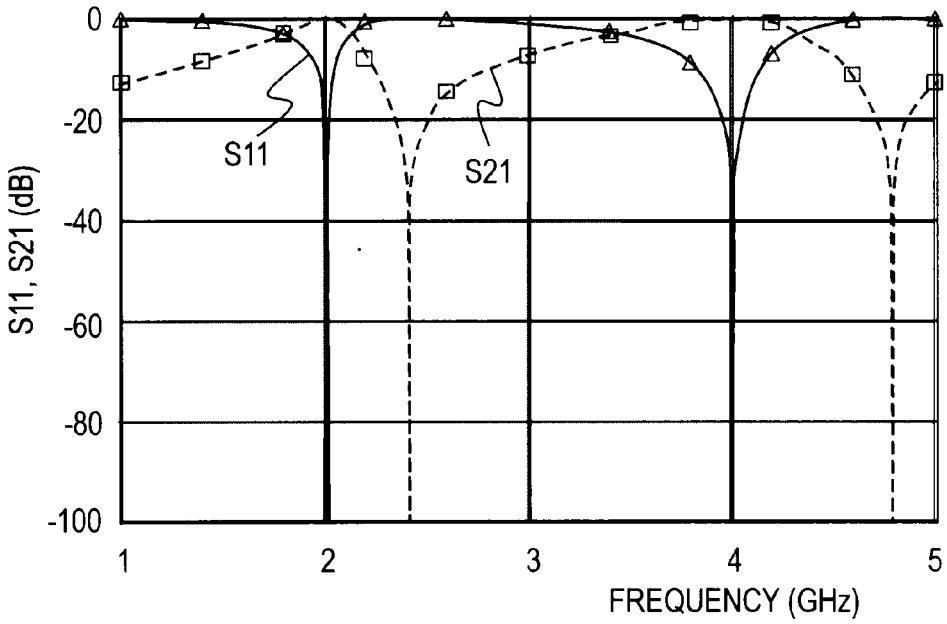
FIG. 3A shows frequency characteristics in the case where the model shown in FIG. 2 is grounded at a position distant from an input line by an electrical length of 30°.

It is assumed that the characteristic impedances of the input line 111 and the output line 112 are equal to port impedances at an input port P1 and an output port P2, respectively, and are 50Ω in this example. It is assumed that the switch circuits 150 (the switches 150*a* in the example shown in FIG. 1A) are ideal, the impedance between the terminals of the switch 150*a* is infinite when the switch 150*a* is in the off state and is zero when the switch 150*a* is in the on state. Thus, instead of selecting the switch circuit to be turned on, the point at which the second transmission line 102 is grounded is changed. Each of the sections of the transmission lines 101 and 102 shown by the dotted lines has an electrical length of 10° (π/18 rad). Therefore, the point of connection denoted by reference character G1 is a point where the electrical length from the one end 101*a*, 102*a* is 30°, and the point of connection denoted by reference character G2 is a point where the electrical length from the one end 101*a*, 102*a* is 60°. FIG. 3A shows frequency characteristics in the case where the second transmission line 102 is grounded only at the point of connection G1, and FIG. 3B shows frequency characteristics in the case where the second transmission line 102 is grounded only at the point of connection G2.

Figure 3B:
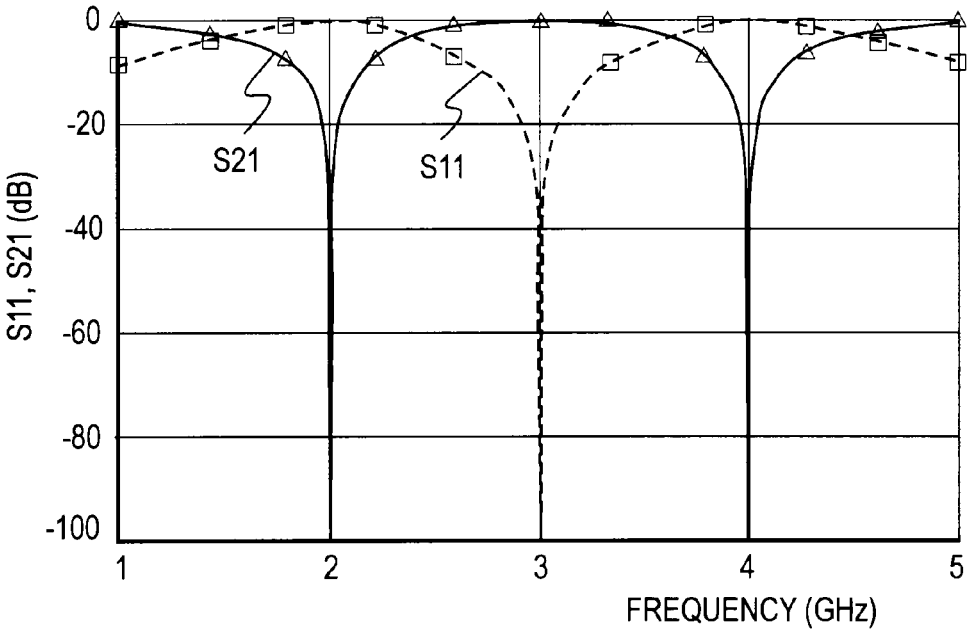
FIG. 3B shows frequency characteristics in the case where the model shown in FIG. 2 is grounded at a position distant from an input line by an electrical length of 60°.

In FIGS. 3A and 3B, the abscissa indicates frequency, and the ordinate indicates a reflection coefficient S11 viewed from the input line 111 or a transmission coefficient S21 from the input line 111 to the output line 112. In the graphs, the solid line indicates the reflection coefficient, and the dashed line indicates the transmission coefficient. Since the variable resonator 100 resonates (serial resonance) at the fundamental frequency of 2 GHz, the reflection coefficient S11 is at the minimum at 2 GHz, and the transmission coefficient S21 is at the maximum at 2 GHz. As can be seen from FIGS. 3A and 3B, the variable resonator 100 resonates at 2 GHz in both the cases. Resonance also occurs at 4 GHz, which is twice as high as the fundamental frequency. In addition, it can be seen from the transmission coefficient S21 in FIGS. 3A and 3B that the bandwidth centered at the resonance frequency of 2 GHz is significantly narrower in the case of the point of grounding G1 than in the case of the point of grounding G2. This shows that the bandwidth of the variable resonator 100 can be changed while maintaining the constant resonance frequency by changing the switch circuit 150 to be turned on. In addition, as is apparent from the drawings, at 4 GHz, which is twice as high as the fundamental frequency, the bandwidth is wider in the case shown in FIG. 3A (the case of the point of grounding G1) than in the case shown in FIG. 3B (the case of the point of grounding G2). In any case, for the variable resonator according to the present invention shown in FIGS. 1A, 1B and 2, the bandwidth can be changed without changing the resonance frequency by changing the point of grounding or the switch circuit to be grounded. In addition, the resonance frequency may be the fundamental resonance frequency or an integral multiple of the fundamental resonance frequency.

The frequency characteristics of the variable resonator 100 shown by this simulation are not the characteristics obtained only for the values of the characteristic impedances for the even mode and the odd mode but can be applied to other values. It is ideal that the characteristic impedance for the even mode and the characteristic impedance for the odd mode are uniform in the length direction of the transmission lines 101 and 102. However, in actual, the switch circuits 150 connected to the transmission lines are not ideal, and the circuit design is also not necessarily ideal because of various conditions, such as pads used to mount the switch circuits 150. As a result, the resonance frequency may slightly vary when the bandwidth is changed. However, such a variation is acceptable if the variation falls within a range required for the application of the variable resonator.

Figure 4:
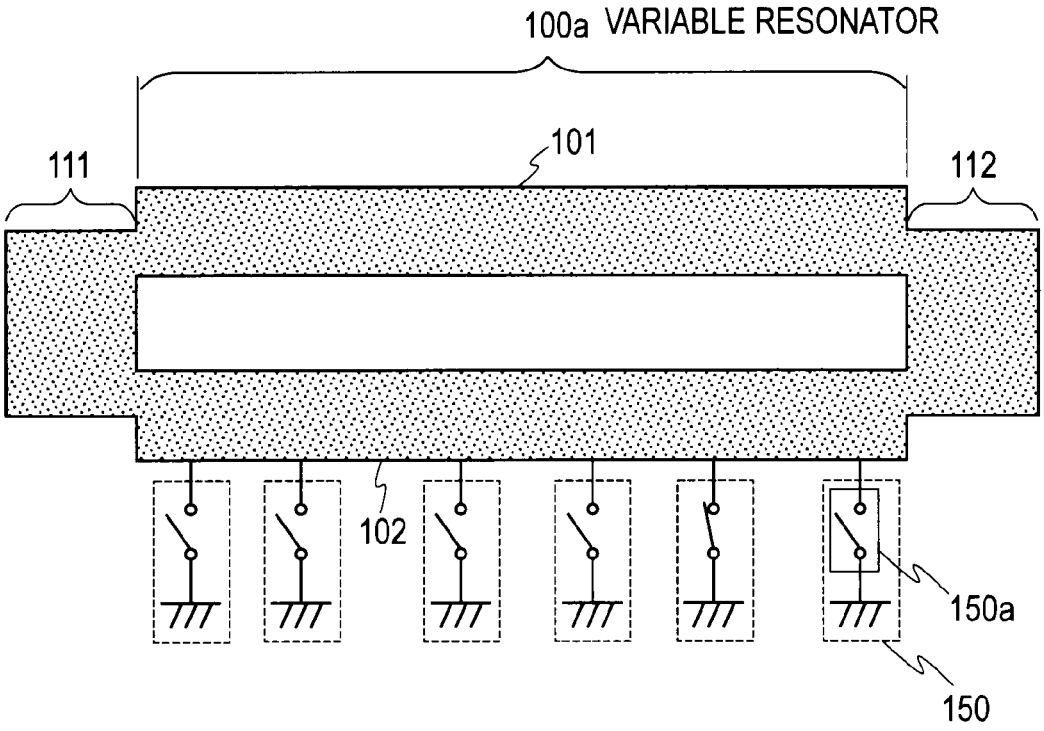
FIG. 4 shows a modification of the variable resonator shown in FIG. 1A.

FIG. 4 shows a variable resonator 100*a* in which the two transmission lines 101 and 102 are wider than those of the variable resonator 100 shown in FIG. 1A and the outer edge of each transmission line 101, 102 in the width direction projects beyond the outer edges of the input line 111 and the output line 112 in the width direction. As can be seen from this example, as far as the characteristic impedance for the even mode and the characteristic impedance for the odd mode of the transmission lines 101 and 102 are uniform in the length direction, the outer edge of each transmission line 101, 102 does not have to be aligned with the outer edges of the input line 111 and the output line 112.

Figure 5:
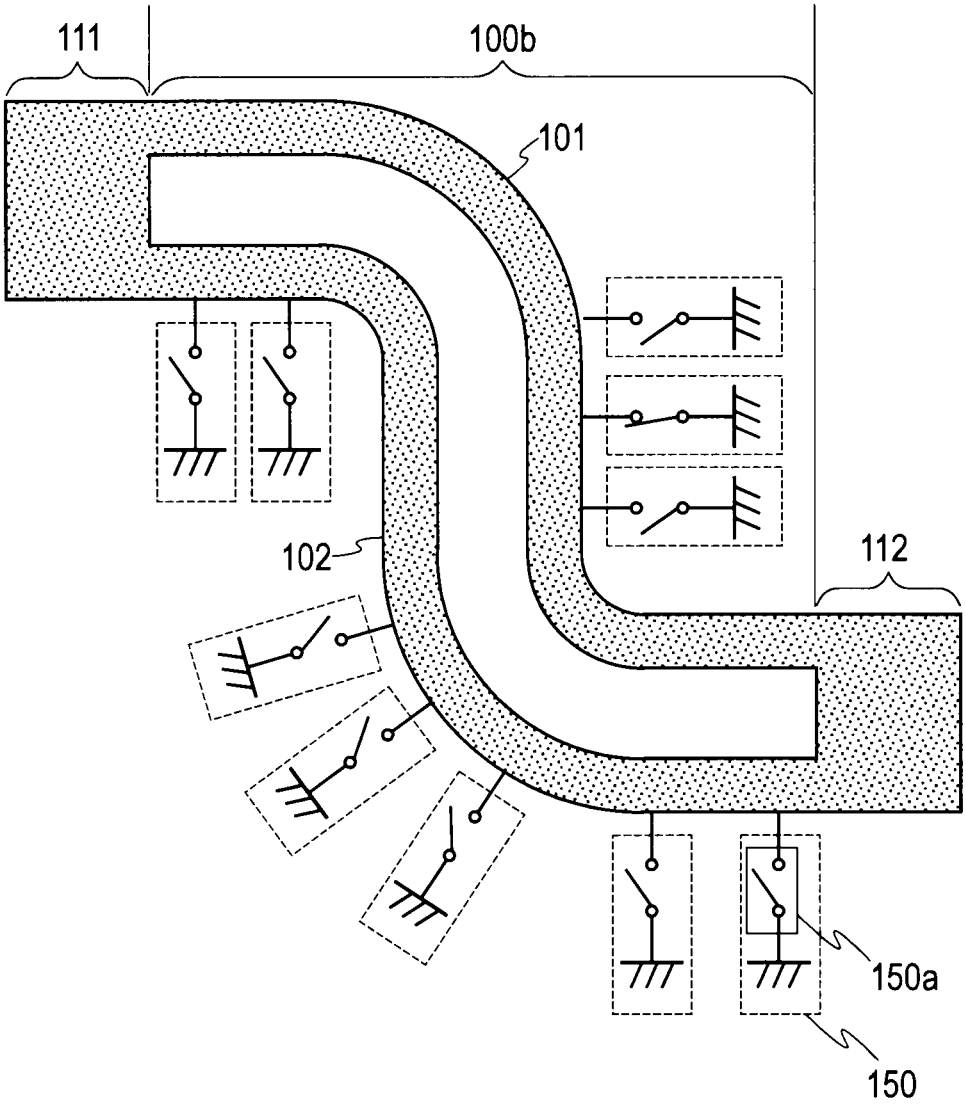
FIG. 5 shows a modification of the variable resonator shown in FIG. 1A.

FIG. 5 shows a variable resonator 100*b* in which the transmission lines 101 and 102 are curved unlike the variable resonator 100 shown in FIG. 1A. As can be seen from this example, as far as the characteristic impedance for the even mode and the characteristic impedance for the odd mode of the two transmission lines 101 and 102 are uniform in the length direction, the shape of each transmission line 101, 102 of the variable resonator is not limited to the straight line. However, the two transmission lines 101 and 102 have to meet the conditions (1) to (5).

Figure 6:
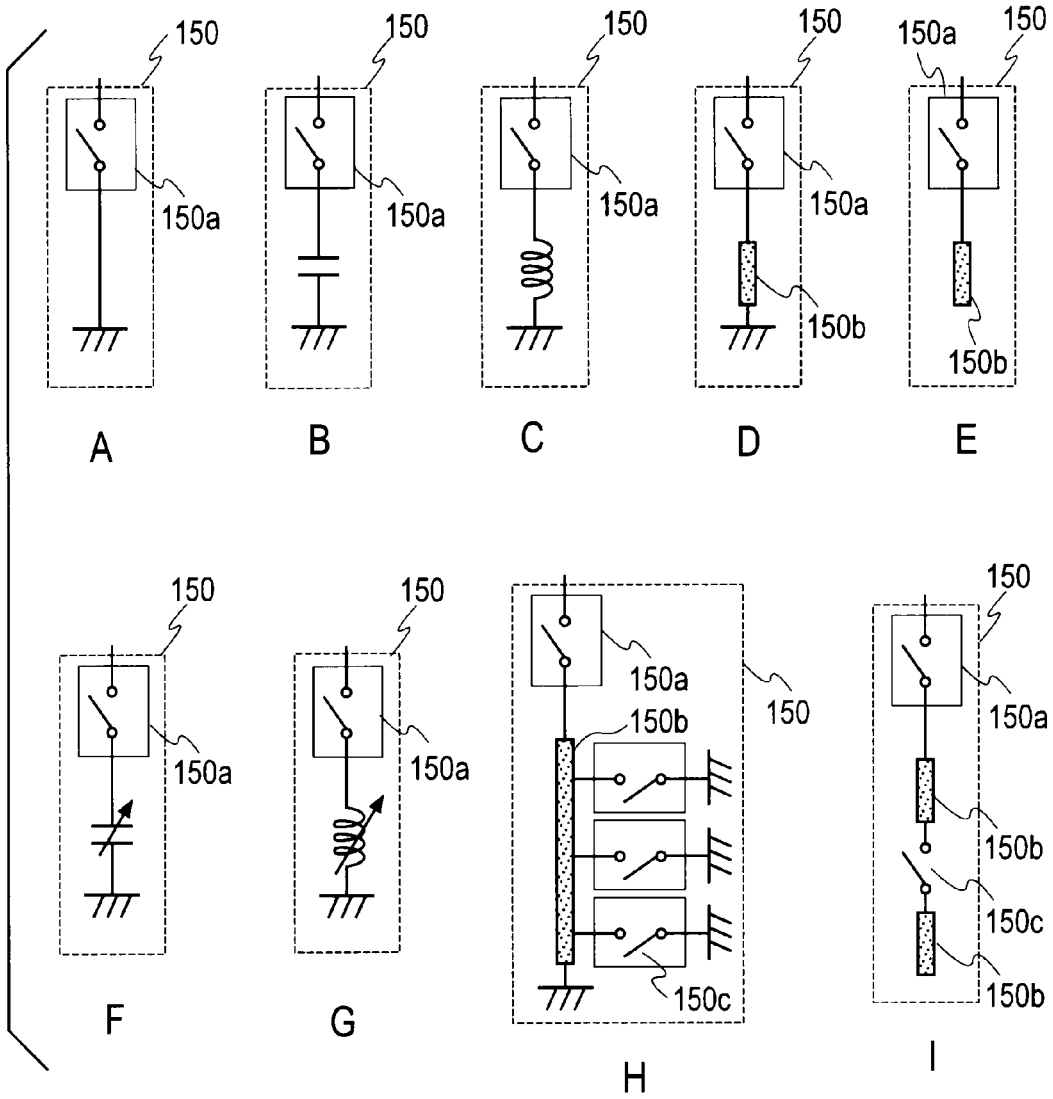
FIG. 6 shows specific examples of the configuration of a switch circuit.

FIG. 6 shows specific examples of the switch circuit 150. The switch circuit 150 denoted by reference character A comprises a switch 150*a* that is directly grounded at the other end.

The switch circuit 150 denoted by reference character B has a capacitor that is connected to the other end of the switch 150*a* at one end and grounded at the other end.

The switch circuit 150 denoted by reference character C has an inductor that is connected to the other end of the switch 150*a* at one end and grounded at the other end.

The switch circuit 150 denoted by reference character D has a transmission line 150*b* that is connected to the other end of the switch 150*a* at one end and grounded at the other end. In this case, the transmission line 150*b* has a line length of a quarter wavelength at the operating frequency at the time when the switch circuit is in the on state.

The switch circuit 150 denoted by reference character E has a transmission line 150*b* that is connected to the other end of the switch 150*a* at one end and is open at the other end. In this case, the transmission line 150*b* has a line length of a half wavelength at the operating frequency at the time when the switch circuit is in the on state.

The switch circuit 150 denoted by reference character F has a variable capacitor capable of changing the capacitance that is connected to the other end of the switch 150*a* at one end and grounded at the other end.

The switch circuit 150 denoted by reference character G has a variable inductor capable of changing the inductance that is connected to the other end of the switch 150*a* at one end and grounded at the other end.

The switch circuit 150 denoted by reference character H has a transmission line 150*b* that is connected at one end thereof to the other end of the switch 150*a* and grounded at the other end. One or more switches 150*c* are connected at one end thereof to different points on the transmission line 150*b*, and the switches 150*c* are grounded at the other end. The characteristics of the switch circuit 150 can be changed by turning on and off these switches 150*c*.

The switch circuit 150 denoted by reference character I has a plurality of transmission lines 150*b* that are connected in series with each other via a switch 150*c*, and one of the transmission lines is connected at one end thereof to the other end of the switch 150*a*. The characteristics of the switch circuit 150 can be changed by turning on and off the switch 150*c* between the transmission lines.

Figure 7:
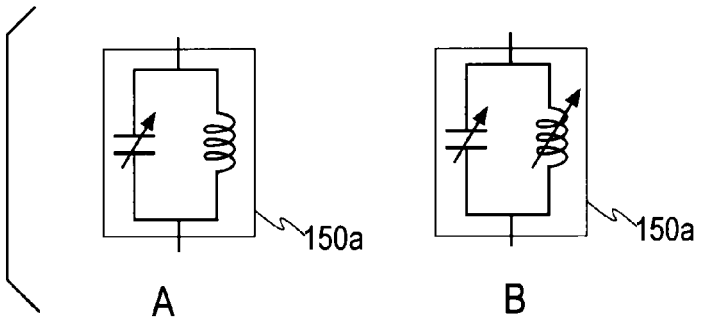
FIG. 7 shows specific example of the configuration of a switch in the switch circuit.

Not only the switch 150*a* but also the "switch" generally used in this specification refers to any contact-type switch, such as a micro-electro mechanical systems (MEMS) switch, or any switching element such as those using a diode or a transistor capable of opening and closing a circuit without using a contact in a circuit network. The switching element is not limited to an ohmic switch that passes a direct current when the switch is in the on state but can be a capacitive switch that blocks a direct current and passes an alternating current when the switch is in the on state. Furthermore, as shown in FIG. 7 by reference characters A and B, the switch 150*a* can be a parallel resonant circuit capable of changing the resonance frequency. In this case, to turn off the switch circuit 150, the resonance frequency of the parallel resonant circuit is made to agree with the resonance frequency of the variable resonator formed by the two transmission lines 101 and 102. On the other hand, to turn on the switch circuit 150, the characteristics of the parallel resonant circuit is set to prevent the parallel resonant circuit from resonating at the resonance frequency of the variable resonator formed by the two transmission lines 101 and 102. As shown in FIG. 7 by reference characters A and B, the resonance frequency of the parallel resonant circuit is changed by changing the capacitance of a variable capacitor or the inductance of a variable inductor, for example. As an alternative, an equivalent variable parallel resonator may be formed by using the combination of the line 150*b* and the switches 150*c* shown in FIG. 6 by reference numeral H and grounding the line at a point where the line has an electrical length of $\lambda/4$ at a desired operating frequency. As a further alternative, a variable parallel resonator having an open end and an electrical line length of $\lambda/2$ at a desired operating frequency may be formed by using a plurality of lines connected to each other via a switch as shown in FIG. 6 by reference character I.

The configuration of the switch circuit 150 is not limited to these configurations. The frequency characteristics of the variable resonator can be changed to a desired shape depending on the configuration of the switch circuit 150. However, the resonance frequency of the variable resonator does not change from the resonance frequency determined by the line length of the two transmission lines 101 and 102.

The characteristics of the variable resonator 100 comprising two transmission lines 101 and 102 and a plurality of switch circuits 150 as a resonator capable of changing the bandwidth have been described above. The variable resonator 100 can serve not only as a resonator but also as a transmission line. In particular, the variable resonator 100 serves as a transmission line when only one switch circuit 150 is provided, for example, when the variable resonator 100 shown in FIG. 1A has only one switch circuit 150. The switch circuit is connected to one of the two transmission lines 101 and 102 at a point other than the ends of the transmission line. The circuit element denoted by reference numeral 100 is a multirole circuit element that does not serve as a variable resonator capable of changing the bandwidth but serves as a transmission line when the switch circuit 150 is in the off state, and serves as a resonator having a certain bandwidth when the switch circuit 150 is in the on state. Of course, the variable resonators 100*a* and 100*b* shown in FIGS. 4 and 5 can serve as both a resonator and a transmission line. However, the variable resonator 100 will be described as a representative.

Figure 8:
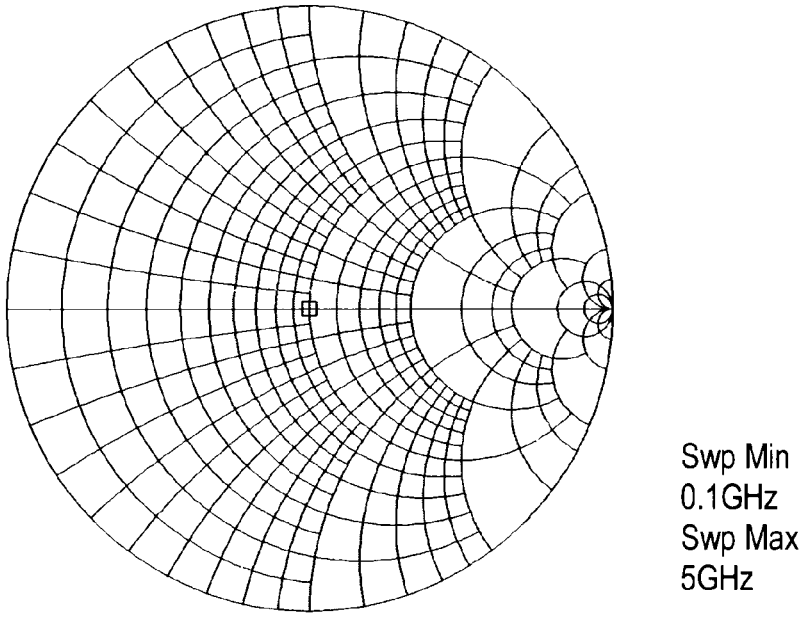
FIG. 8 is a Smith chart for the variable resonator shown in FIG. 1A in the case where all the switch circuits are turned off.
Figure 9:
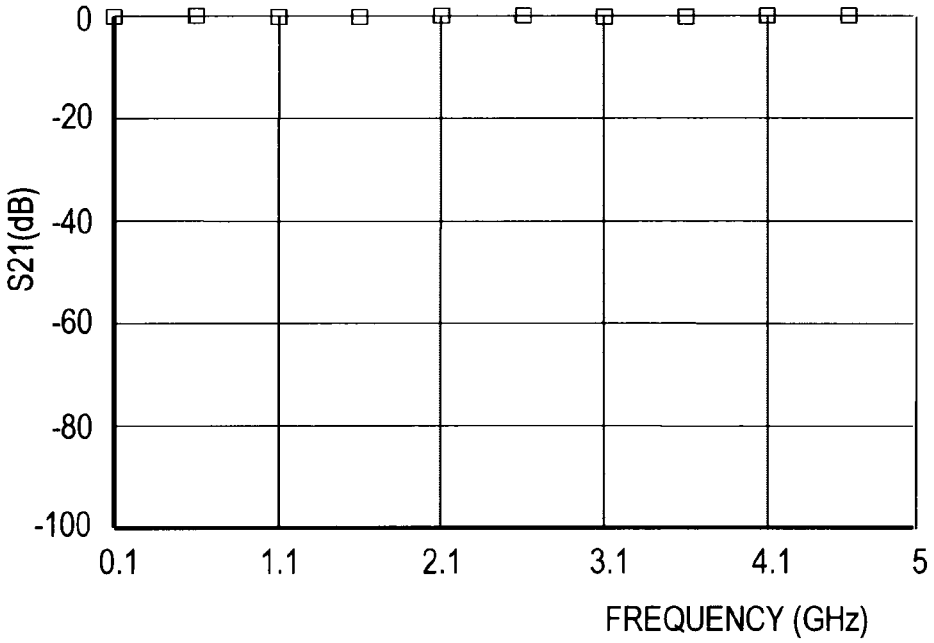
FIG. 9 shows transfer characteristics of the variable resonator shown in FIG. 1A in the case where all the switch circuits are turned off.

With regard to the variable resonator 100 shown in FIG. 1A, FIG. 8 shows the input impedance viewed from the input line 111 in the case where all the switch circuits 150 are turned off, and FIG. 9 shows the transmission coefficient S21 from the input line 111 to the output line 112 in the same case. The characteristic impedances for the even mode and the odd mode of the two transmission lines 101 and 102, the characteristic impedance of the input line 111 and the characteristic impedance of the output line 112 are the same as those of the model shown in FIG. 2. FIG. 8 shows the input impedance in a frequency range of 0.1 to 5 GHz on the Smith chart, and the center of the Smith chart is 50Ω. As can be seen from this drawing, the input impedance is fixed at 50Ω. This is because even mode propagation occurs on the two transmission lines

101 and 102, the characteristic impedance for the even mode in the model shown in FIG. 2 is 100Ω, which is twice as high as the characteristic impedance of the input line 111 and the output line 112 and the port impedance of the input port P1 and the output port P2, and therefore, the parallel connection of the two transmission lines 101 and 102, that is, the two transmission lines 101 and 102 are equivalent to one transmission line having a characteristic impedance of 50Ω.

As can be seen from FIG. 9, signals in the wide band of 0.1 to 5 GHz propagate as with a common 50Ω transmission line. Thus, it can be seen that when all the switch circuits 150 are turned off, the variable resonator 100 operates in the same way as a common transmission line. However, depending on the value of the characteristic impedance for the even mode, impedance matching may not be achieved between the two transmission lines 101 and 102 and the input line 111 and the output line 112. Thus, the line width W of and the distance D between the two transmission lines 101 and 102 are ideally designed so that the characteristic impedance for the even mode is twice as high as the characteristic impedance of the input line 111 and the output line 112 and the port impedance of the input port P1 and the output port P2. However, the ideal condition does not have to be satisfied if it is acceptable under the design requirements of the application of the circuit element or the variable resonator. When the circuit element or the variable resonator serves as a transmission line, the two transmission lines 101 and 102 can serve as a part or the whole of a K-inverter in a variable filter described later.

Figure 10:
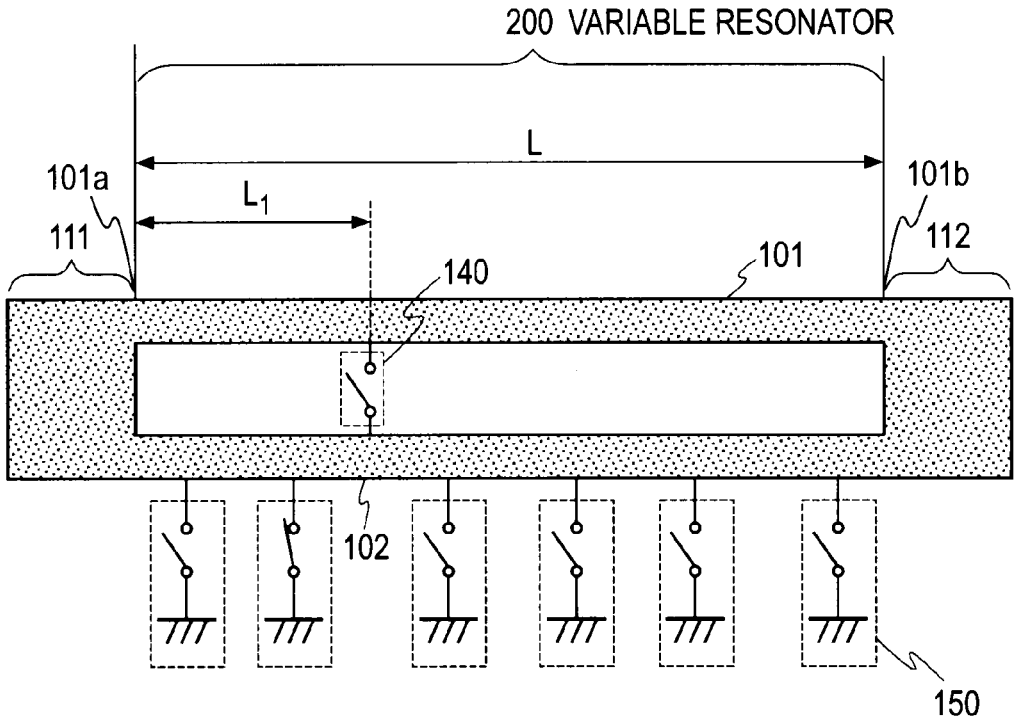
FIG. 10 is a plan view of a variable resonator capable of changing the bandwidth and the resonance frequency.

FIG. 10 shows a configuration of a variable resonator 200 capable of changing the resonance frequency and the bandwidth having a microstrip line structure according to an embodiment of the present invention. The variable resonator 200 differs from the variable resonator 100 shown in FIG. 1A in that the variable resonator 200 has a switch 140 that links the two transmission lines 101 and 102 with each other. The number of switches 140 that link the two transmission lines 101 and 102 with each other is not limited to one, and the variable resonator 200 can have a plurality of switches (see FIGS. 13A, 13B, 13C and 14). In this case, provided that the variable resonator 200 has R switches $S_r$ (r=1, 2, . . . , R) serving as the switch 140, where reference character R denotes a predetermined integer equal to or greater than 1, and reference character r denotes an integer equal to or greater than 1 and equal to or smaller than R, the r-th switch $S_r$ from the input line 111 is connected to the first transmission line 101 at one end and to the second transmission line 102 at the other end in such a manner that the electrical length between the point of connection of the one end of the switch $S_r$ to the first transmission line 101 and the one end 101*a* of the first transmission line 101 is equal to the electrical length between the point of connection of the other end of the switch $S_r$ to the second transmission line 102 and the one end 102*a* of the second transmission line 102.

When the switch 140 in the variable resonator 200 shown in FIG. 10 is turned on, and any one of the switch circuits 150 connected to a part (the section of the transmission line 102 having a line length $L_1$ between the switch 140 and the input line 111 in this example) of the two transmission lines 101 and 102 is turned on, the variable resonator 200 operates as a resonator that resonates at a frequency at which the length $L_1$ is a half wavelength. Since $L_1<L$, when the switch 140 is in the on state, the variable resonator 200 resonates at a frequency higher than the resonance frequency at the time when the switch 140 is in the off state. If all the switch circuits 150 in the section between the switch 140 and the output line 112 (having a length of $L-L_1$) are turned off, the section of the line operates as a normal transmission line. The switch 140 that links the transmission lines 101 and 102 with each other can be provided, though not shown, by forming a dielectric layer over the two transmission lines, forming the switch 140 on the dielectric layer and connecting one end of the switch 140 to the first transmission line and the other end to the second transmission line through via holes formed in the dielectric layer, for example. Wiring for controlling turn on and off of the switch 140 can be run from on the dielectric layer to a desired position on the dielectric substrate 805 (see FIG. 1) on which the transmission lines 101 and 102 are formed. An operation of the variable resonator 200 configured as shown in FIG. 10 as a resonator capable of changing both the resonance frequency and the bandwidth will be described with reference to a simulation using the model shown in FIG. 11A.

Figure 11A:
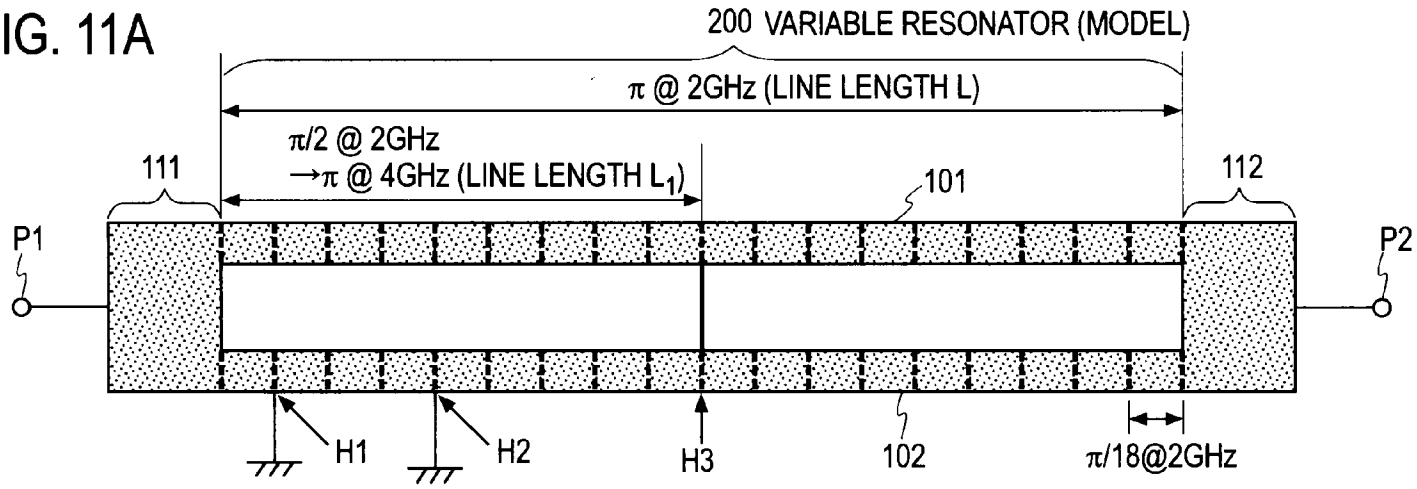
FIG. 11A shows a model of the variable resonator shown in FIG. 10 in the case where the variable resonator is grounded only at a position H3.
Figure 12A:
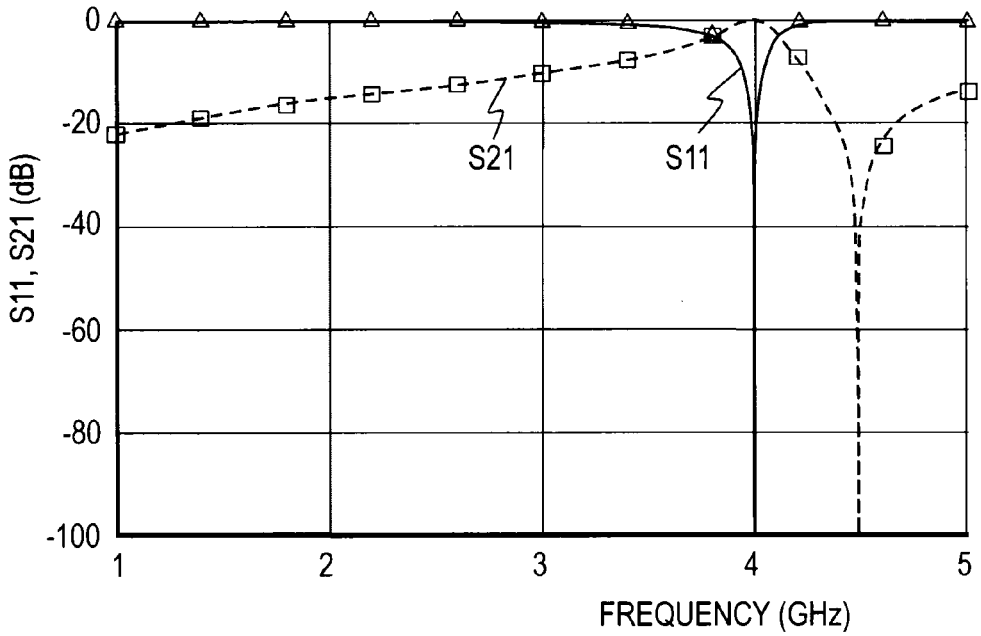
FIG. 12A shows frequency characteristics of the model shown in FIG. 11A in the case where the variable resonator is grounded at a position distant from the input line by an electrical length of 10°.

FIG. 11A shows a configuration of a model based on the model shown in FIG. 2 in which an ideal switch 140 is provided between the center of the transmission line 101 and the center of the transmission line 102 and turned on. As with the model shown in FIG. 2, the point of grounding is changed as an alternative to changing the switch circuit 150 to be turned on. The point of connection denoted by reference character H1 is a position where the electrical length from the one end 101*a*, 102*a* is 10° at 2 GHz, and the point of connection denoted by reference character H2 is a position where the electrical length from the one end 101*a*, 102*a* is 40° at 2 GHz. FIG. 12A shows frequency characteristics in the case where only the point of connection H1 is grounded, and FIG. 12B shows frequency characteristics in the case where only the point of connection H2 is grounded.

Figure 12B:
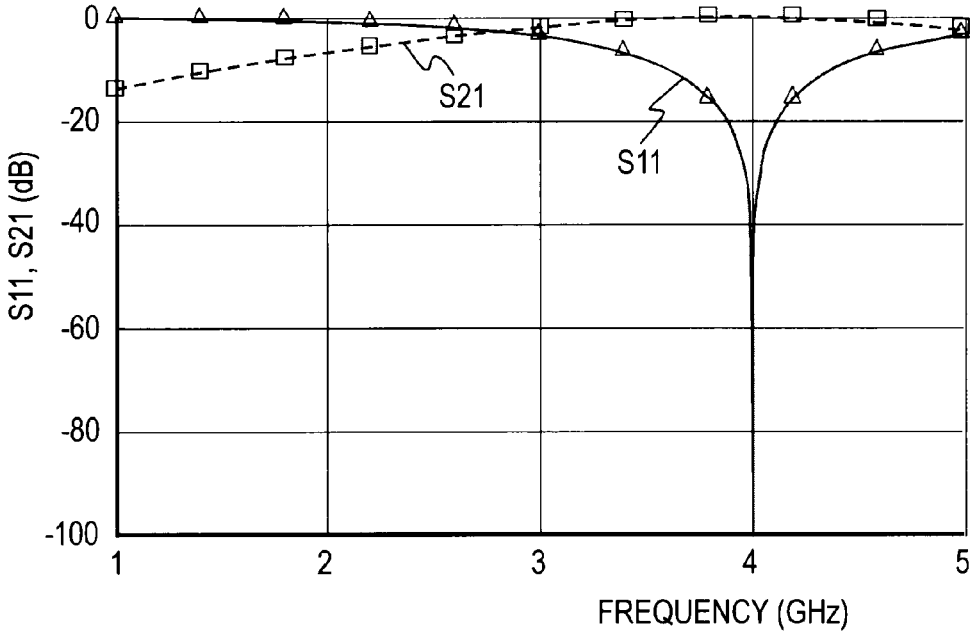
FIG. 12B shows frequency characteristics of the model in the case where the variable resonator is grounded at a position distant from the input line by an electrical length of 40°.

In FIGS. 12A and 12B, the abscissa indicates frequency, and the ordinate indicates the reflection coefficient S11 viewed from the input line 111 or the transmission coefficient S21 from the input line 111 to the output line 112. In the graphs, the solid line indicates the reflection coefficient S11, and the dashed line indicates the transmission coefficient S21. As can be seen from FIGS. 12A and 12B, when the switch 140 is in the on state, the fundamental resonance frequency is 4 GHz, which is twice as high as the fundamental resonance frequency of 2 GHz at the time when the switch 140 is in the off state (see FIGS. 3A and 3B). This is because the switch 140 is placed at a position where the electrical length from the points of connection of the two transmission lines 101 and 102 to the input line 111 is 90° at 2 GHz, and therefore, when the switch 140 is in the on state, the section having the line length $L_1$ between the switch 140 and the input line 111 serves as a resonator, and the length $L_1$ is a half wavelength (an electrical length of 180°) at 4 GHz.

In addition, as is apparent from the transfer characteristics S21 shown in FIGS. 12A and 12B, the bandwidth at 4 GHz significantly differs between the case where the position of the switch circuit 150 in the on state is H1 and the case where the position of the switch circuit 150 in the on state is H2. More specifically, the bandwidth centered at the resonance frequency 4 GHz is significantly narrower in the case where the grounding position is H1 than in the case where the grounding position is H2. Meanwhile, the resonance frequency is not changed from 4 GHz. Thus, the variable resonator 200 shown in FIG. 10 can change both the resonance frequency and the bandwidth and can keep the resonance frequency constant even when the bandwidth is changed.

Figure 13A:
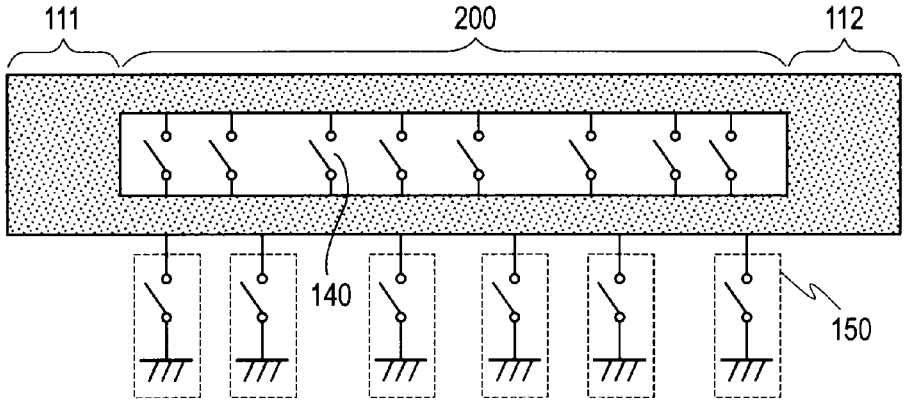
FIG. 13A shows a modification of the variable resonator shown in FIG. 10 in which a plurality of switches are provided between transmission lines.
Figure 13B:
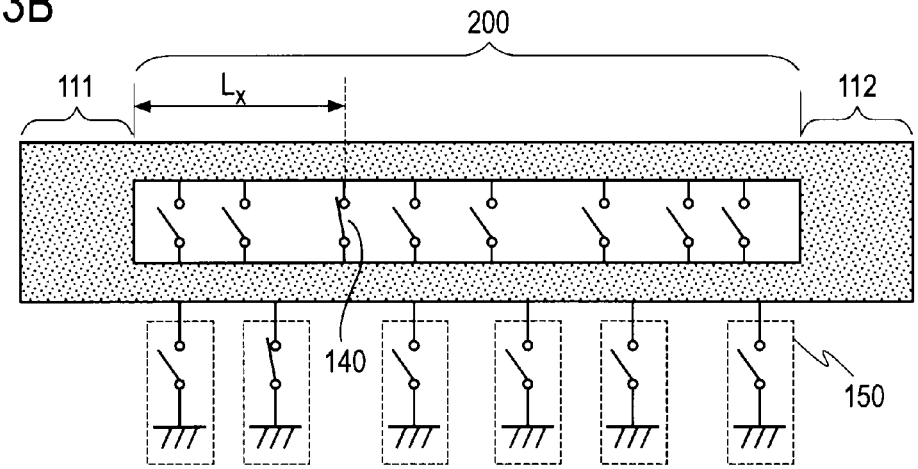
Figure 13C:
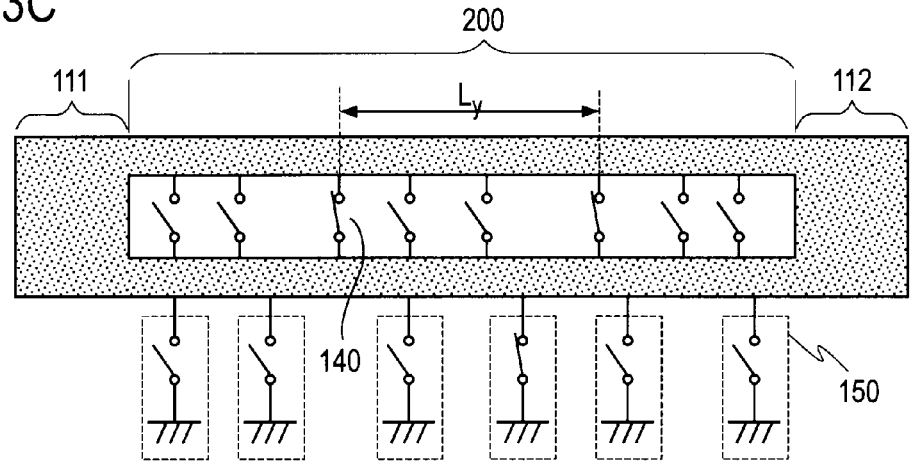
Figure 14:
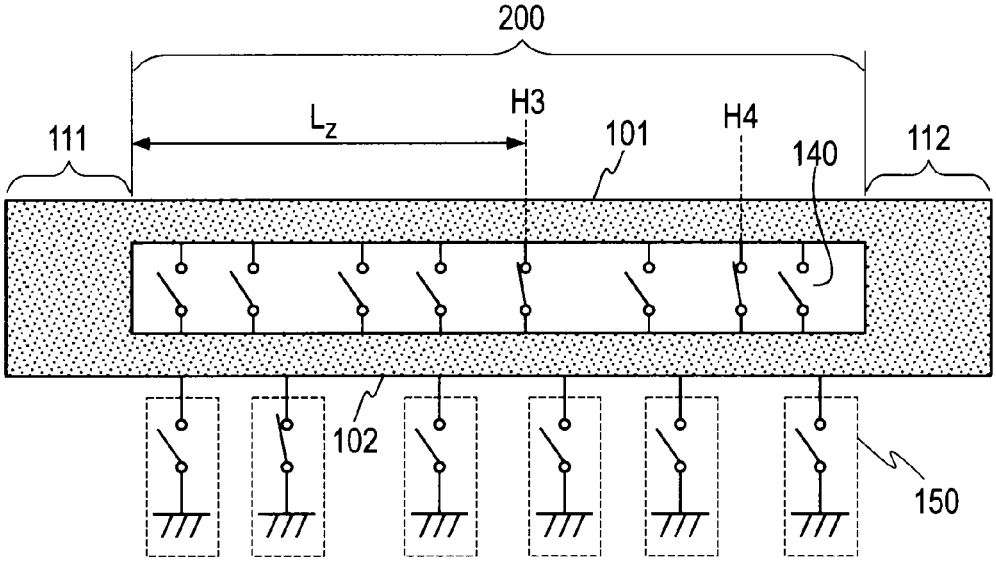

In the case where the variable resonator 200 has a plurality of switches 140 as shown in FIGS. 13A, 13B and 13C, the variable resonator 200 can operate at more resonance frequencies. In the case where only one of the plurality of switches 140 is turned on as shown in FIG. 13B, the section having a line length $L_x$ from the input line 111 to the switch 140 turned on operates as a resonator that resonates at a resonance frequency at which the line length $L_x$ is a half wavelength. Therefore, when the switch 140 turned on is changed, the variable resonator 200 operates at the resonance frequency corresponding to the position of the switch 140 turned on. In this case, any one of the switch circuits 150 connected to the section having the line length $L_x$ from the switch 140 turned on to the input line 111 (in other words, the section of the two transmission lines 101 and 102 forming a closed loop in cooperation with the switch 140 turned on and the input line 111) is turned on. The section from the switch 140 turned on to the output line 112 (having a length of $L-L_x$) does not serve as a resonator but as a transmission line.

In the case where only two of the plurality of switches 140 are turned on as shown in FIG. 13C, when one switch circuit 150 located in the section having a line length $L_y$ between the two switches 140 turned on is turned on, the section having the line length $L_y$ operates as a resonator that resonates at a resonance frequency at which the line length $L_y$ is a half wavelength. Therefore, when the combination of the switches 140 turned on is changed, the variable resonator 200 operates at the resonance frequency corresponding to the combination of the switches 140 turned on. In this case, any one of the switch circuits 150 connected to the section having the line length $L_y$ between the two switches 140 turned on (in other words, the section of the two transmission lines 101 and 102 forming a closed loop in cooperation with the two switches 140 turned on) is turned on. The section from one of the two switches 140 turned on that is closer to the input line 111 to the input line 111 and the section from the other of the two switches 140 to the output line 112 do not serve as a resonator but as a transmission line.

As shown in FIGS. 13B and 13C, for the variable resonator 200, the whole of the structure denoted by reference numeral 200 does not always operate as a resonator, and a part of the structure denoted by reference numeral 200 may operate as a resonator. Therefore, the variable resonator 200 should be regarded as "a variable resonator the whole or a part of which operates as a resonator capable of changing the bandwidth, thereby changing the resonance frequency". Of course, the state where "the whole of the structure denoted by reference numeral 200 operates as a resonator" is achieved when all the switches 140 in the variable resonator 200 are turned off, and one of the switch circuits 150 is turned on. The variable resonator 200 in this state is equivalent to the variable resonator 100 in FIG. 1A, and therefore, redundant descriptions thereof will be omitted.

Figure 15A:
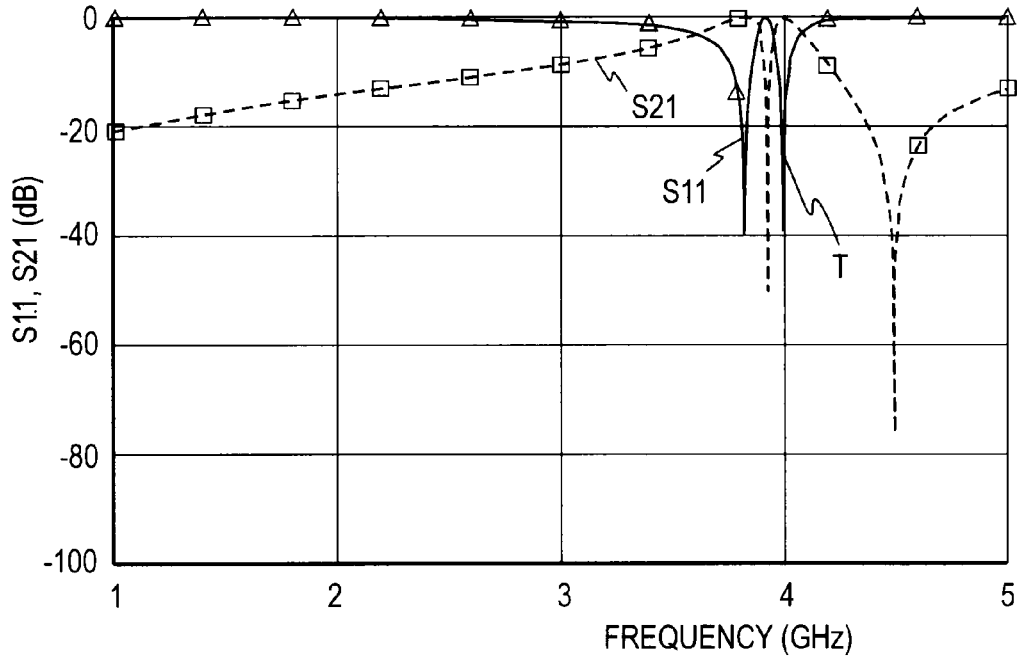

Using the variable resonator 200 with a plurality of switches 140 turned on is advantageous in another respect. This will be described with reference to FIGS. 14, 15A and 15B. In this case, although a plurality of switches 140 are turned on, the section having a line length $L_z$ from the input line 111 to a switch 140 turned on operates as a resonator (at a resonance frequency at which the line length $L_z$ is a half wavelength), unlike the case shown in FIG. 13C. If the ideal switch 140 located at the position denoted by reference character H3 in the model shown in FIG. 11A is replaced with a switch that provides a phase shift equivalent to an electrical length of 2° at 2 GHz when the switch is turned on, another resonance frequency (about 4.0 GHz) occurs in the vicinity of the resonance frequency (about 3.8 GHz) provided by the switch 140 having a phase shift as shown in FIG. 15A by reference character T. This resonance frequency is attributed by the section (having a length of $L-L_z$) from the switch 140 in the on state (at the position H3) to the output line 112 in the case where the second switch 140 from the output line 112 is in the off state (that is, in the case where the three switches 140 closest to the output line 112 are all in the off state) in FIG. 14. The reason why the resonance occurs at approximately the same frequency is that the section (having a length of $L_z$) from the switch 140 (at the position H3) to the input line 111 and the section (having a length of $L-L_z$) from the switch 140 (at the position H3) to the output line 112 happen to be substantially the same.

Figure 11B:
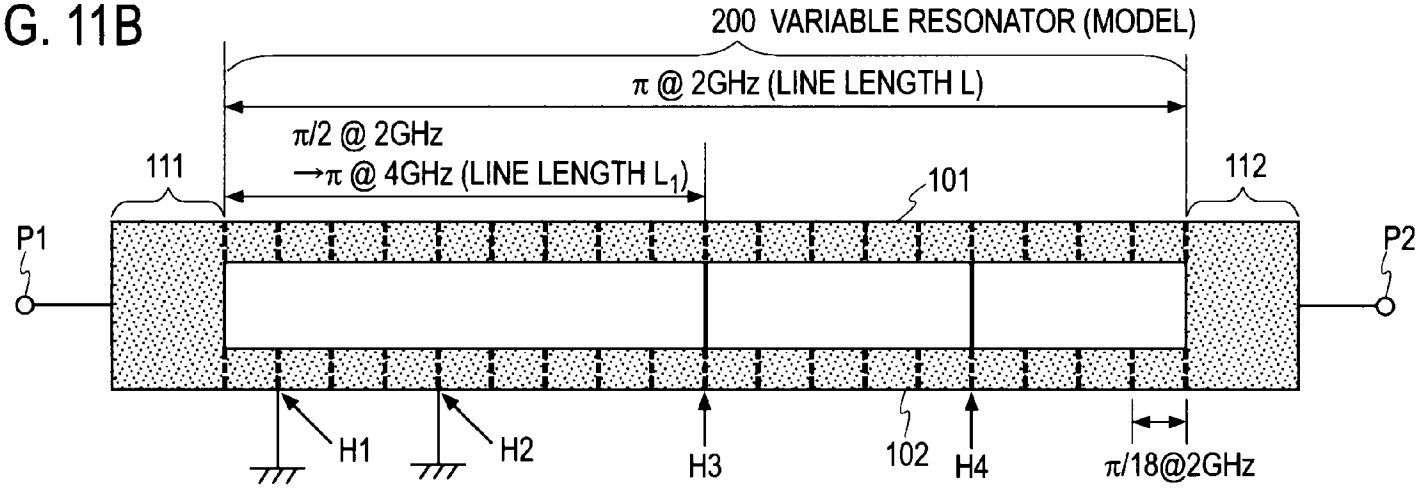
FIG. 11B shows a model of the variable resonator shown in FIG. 10 in the case where the variable resonator is grounded at two positions H3 and H4.
Figure 15B:
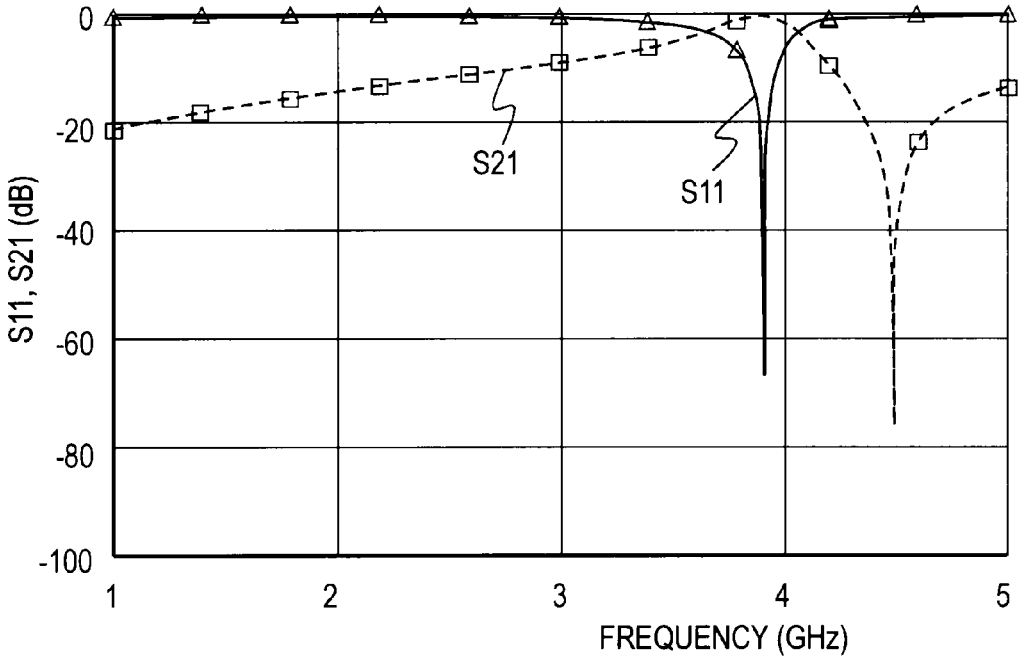
FIG. 15B is a graph illustrating that the unwanted resonance is eliminated by turning on a plurality of switches between the transmission lines.

The unwanted resonance may have an adverse effect when a variable filter is formed. In order to eliminate the adverse effect of the unwanted resonance, it is effective to turn on one or more switches 140 in addition to the switch 140 (at the position H3) that is essentially to be turned on. For example, in the model shown in FIG. 11B, another switch 140 (at a position H4) connected to the section (having a length of $L-L_1$) from the switch 140 turned on (at the position H3) to the output line 112 is turned on. FIG. 15B shows frequency characteristics of the reflection coefficient S11 and the transmission coefficient S21 of the resonator in the case where the phase shift by the switch 140 (at the position H4) is equivalent to an electrical length of 2° at 2 GHz. As can be seen from FIG. 15B, the unwanted resonance is eliminated. This is because, in cooperation with a part of the transmission lines 101 and 102 and the output line 112, the switch having a phase shift connected to the section (having a length of $L-L_1$) from the switch 140 (at the position H3) to the output line 112 forms a closed loop smaller than the closed loop in the case where all the switches closer to the output line than the position H3 are set to an off state, thereby shifting the resonance frequency to a higher frequency. The slight shift of the resonance frequency from 4 GHz toward a lower frequency is due to the phase shift by the switch 140 (at the position H3). The effect of the phase shift can be considered in designing the variable resonator. Although one switch 140 (at the position H4) is turned on in the example described above, a plurality of switches 140 closer to the output line than the position H3 may be turned on. The adverse effect eliminating method described above can be applied to a K-inverter section of a variable filter described later.

Figure 16:
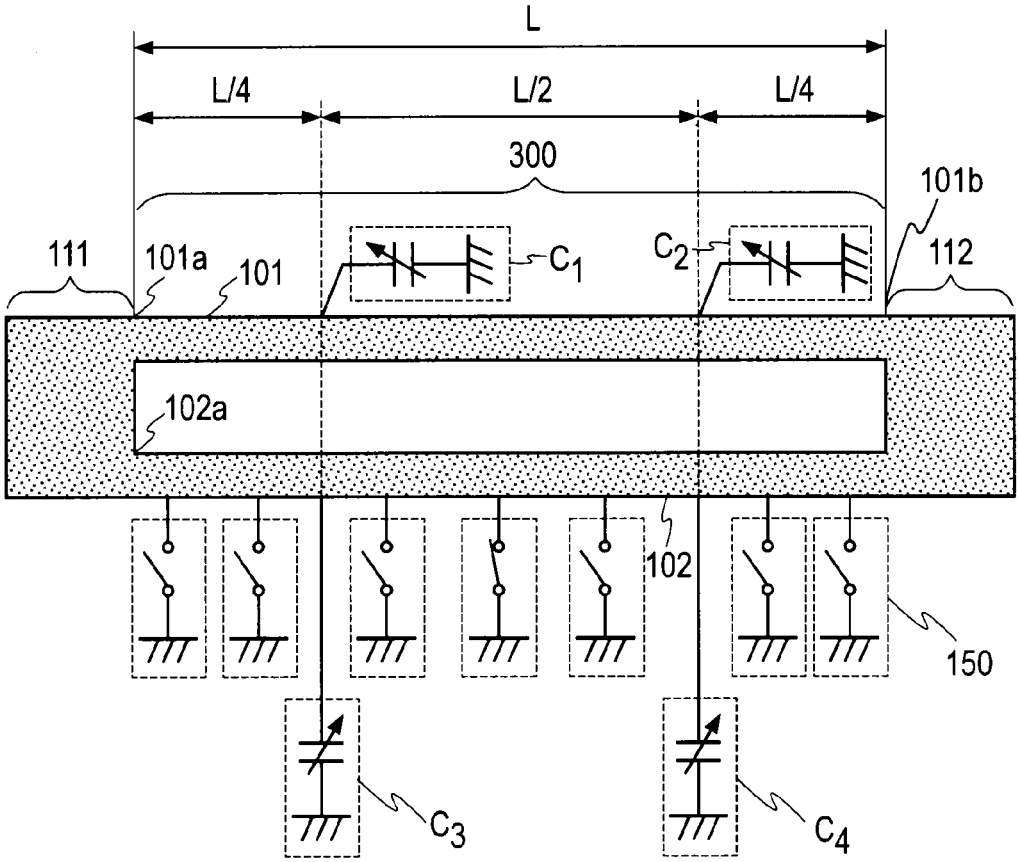
FIG. 16 is a plan view of a variable resonator capable of changing the bandwidth and the resonance frequency.

FIG. 16 shows a variable resonator 300 capable of changing the resonance frequency and the bandwidth according to an embodiment of the present invention. The variable resonator 300 is a variable resonator based on the variable resonator 100 shown in FIG. 1A in which both the first transmission line 101 and the second transmission line 102 have a line length of L, and the variable resonator 300 further has M reactance circuits $C_m$ (m=1, 2, . . . , M), where reference character M represents a predetermined even number equal to or greater than 4, and reference character m represents an integer equal to or greater than 1 and equal to or smaller than M. In the range $1 \le m \le M/2$, the m-th reactance circuit $C_m$ is connected to the first transmission line 101 at a position distant from the one end 101*a* of the first transmission line 101 by $L(2m-1)/M$. In the range $M/2 < m \le M$, the m-th reactance circuit $C_m$ is connected to the second transmission line 102 at a position distant from the one end 102*a* of the second transmission line 102 by $L(2m-M-1)/M$. FIG. 16 shows a configuration in the case where M=4. In this exemplary configuration, the M reactance circuits $C_m$ ($1 \le m \le M$) are variable capacitor capable of changing the capacitance. In operation, the capacitance of the M reactance circuits is set at the same value.

The electrical length from the one end 101*a* of the transmission line 101 to the position of connection of the closest reactance circuit $C_1$ is L/M. Similarly, the electrical length from the other end 101*b* of the transmission line 101 to the position of connection of the closest reactance circuit $C_{M/2}$ is L/M. The electrical length between the positions of connection of each adjacent reactance circuits $C_m$ and $C_{m+1}$ on the transmission lines 101 and 102 is 2L/M. In this way, the transmission lines 101 and 102 are divided into (1+M/2) sections, each section has one or more switch circuits 150, or two or more switch circuits 150 in order to change the bandwidth, connected thereto at different positions, and the switch circuits 150 are connected at one end thereof to the transmission line 101 or 102 and grounded at the other end.

To change the resonance frequency toward a lower frequency, the capacitance of each reactance circuit $C_m$ ($1 \le m \le M$) can be increased. The bandwidth of the variable resonator 300 can be changed by changing the switch circuit 150 to be turned on. To keep the resonance frequency constant while changing the bandwidth of the variable resonator 300, a condition that $Z_{1,even}=Z_{1,odd}=Z_{2,even}=Z_{2,odd}$ is ideally satisfied, where represents the characteristic impedance for the even mode of the first transmission line 101, $Z_{1,odd}$ represents the characteristic impedance for the odd mode of the first transmission line 101, $Z_{2,even}$ represents the characteristic impedance for the even mode of the second transmission line 102, and $Z_{2,odd}$ represents the characteristic impedance for the odd mode of the second transmission line 102. In order to practically satisfy the ideal condition, typically, the distance D between the two transmission lines 101 and 102 can be designed to be equal to or greater than the line width W of the transmission lines. Of course, even a configuration in which $D \le W$ is also acceptable if the variation of the resonance frequency falls within an acceptable range for the application of the variable resonator.

If each of the M reactance circuits $C_m$ ($1 \le m \le M$) is formed by a capacitor having a fixed capacitance, for example, the variable resonator 300 has a fixed resonance frequency and can change only the bandwidth.

The advantage of providing the M reactance circuits $C_m$ ($1 \le m \le M$) having a fixed reactance is that the reactance circuits $C_m$ ($1 \le m \le M$) serves to reduce the resonance frequency to lower than the resonance frequency at which the line length L of the transmission lines 101 and 102 is a half wavelength. In other words, at the same resonance frequency, the line length L is shorter in the configuration shown in FIG. 16 (in which each reactance circuit $C_m$ ($1 \le m \le M$) has a fixed reactance) than in the configuration shown in FIG. 1A.

Figure 17:
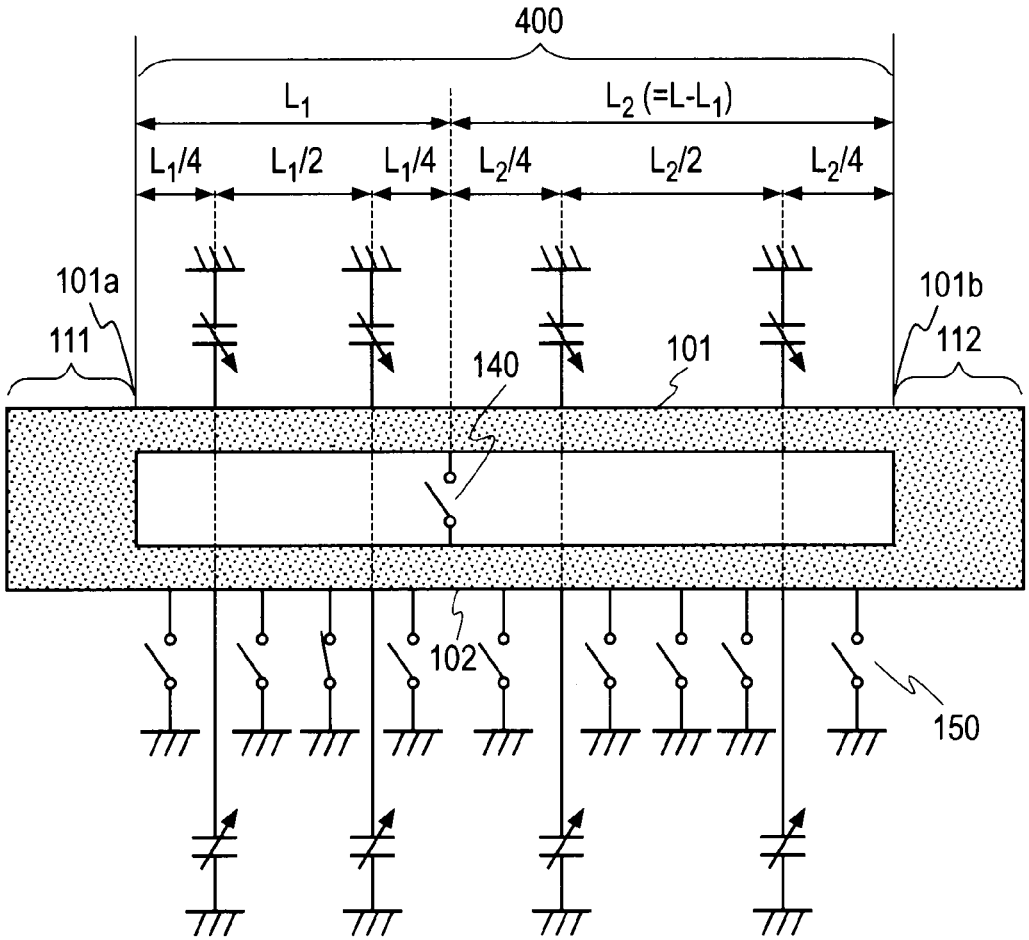
FIG. 17 is a plan view of a variable resonator capable of changing the bandwidth and the resonance frequency.

FIG. 17 shows an example of a variable resonator 400 capable of changing the resonance frequency and the bandwidth, which is a combination of the variable resonator 200 and the variable resonator 300. The section of the variable resonator 400 (having a length $L_1$) from the switch 140 to the input line 111 is configured in the same way as the variable resonator 300, and the section (having a length $L-L_1=L_2$) from the switch 140 to the output line 112 is configured in the same way as the variable resonator 300. Alternatively, only the section of the variable resonator 400 (having a length $L_1$) from the switch 140 to the input line 111 may have the same configuration as the variable resonator 300, for example. The resonance frequency of the variable resonator 400 can be adjusted or changed by roughly changing the resonance frequency by turning on or off the switch 140 and then setting the reactance of the M reactance circuits $C_m$ ($1 \le m \le M$).

A configuration of a variable resonator having R switches $S_r$ ($r=1, 2, \ldots, R$) serving as the switch 140 and a plurality of reactance circuits will be generally described. The R switches $S_r$ are connected to the first transmission line 101 at one end and to the second transmission line 102 at the other end. The distance from the one end 101*a* of the transmission line 101 to the point of connection of the r-th switch $S_r$ and the distance from the one end 102*a* of the transmission line 102 to the point of connection of the r-th switch $S_r$ are equal to each other. The first transmission line 101 and the second transmission line 102 are divided at the points of connection of the R switches $S_r$ into sections $I_1, I_2, \ldots, I_{R+1}$ having lengths of $L_1, L_2, \ldots, L_{R+1}$, respectively. At least one switch circuit 150 is connected to at least one section $I_x$ ($x=1, 2, \ldots, R+1$) of the first or second transmission line. Of $M_x$ reactance circuits $C_{mx}$ ($mx=1, 2, \ldots, M_x$) where $M_x$ represents an even number equal to or greater than 4, the reactance circuits $C_{mx}$ falling within a range $1 \le mx \le M_x/2$ are connected to the first transmission line 101 at positions distant from the end of the section $I_x$ closer to the input line by $L_x(2mx-1)/M_x$, and the reactance circuits $C_{mx}$ falling within a range $M_x/2 < mx \le M_x$ are connected to the second transmission line 102 at positions distant from the end of the section $I_X$ closer to the input line by $L_x(2mx-M_x-1)/M_x$.

Figure 18A:
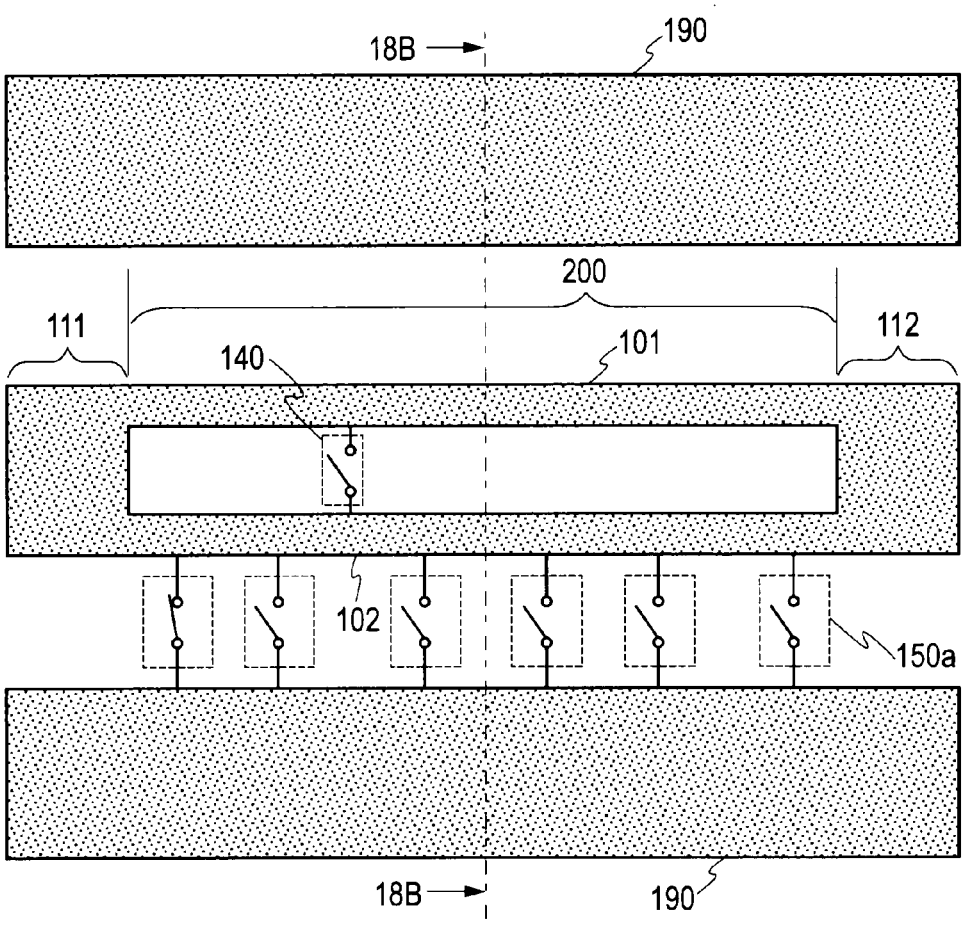
FIG. 18A shows an exemplary line structure for implementing the present invention.
Figure 18B:
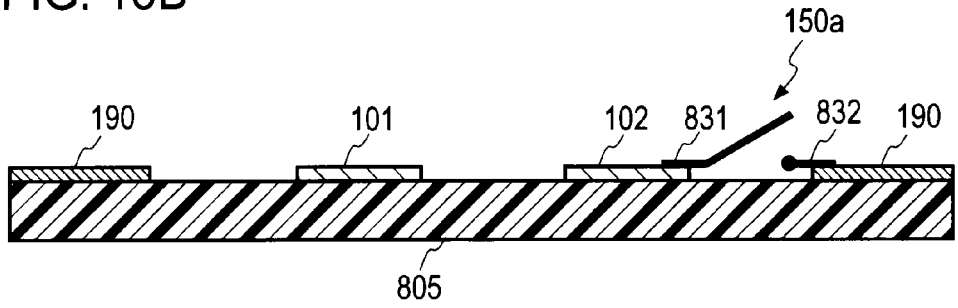
FIG. 18B is a cross-sectional view of the line structure shown in FIG. 18A taken along the line 18B-18B.
Figure 19A:
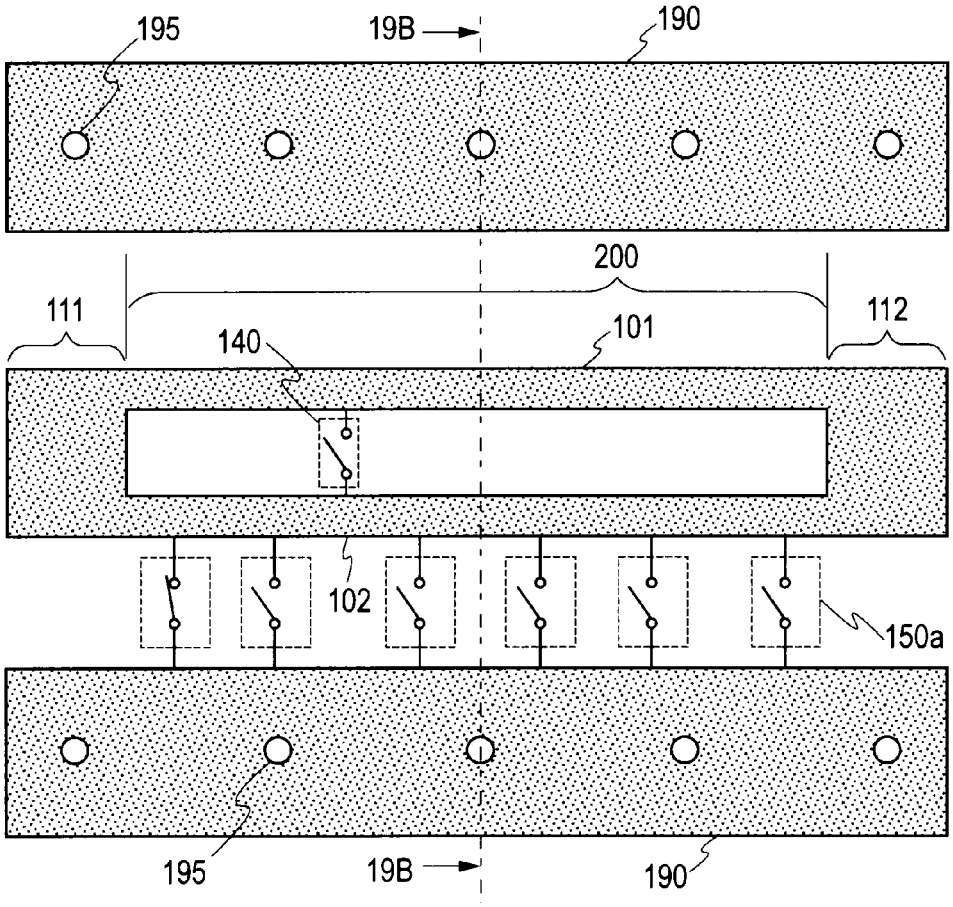
FIG. 19A shows an exemplary line structure for implementing the present invention.
Figure 19B:
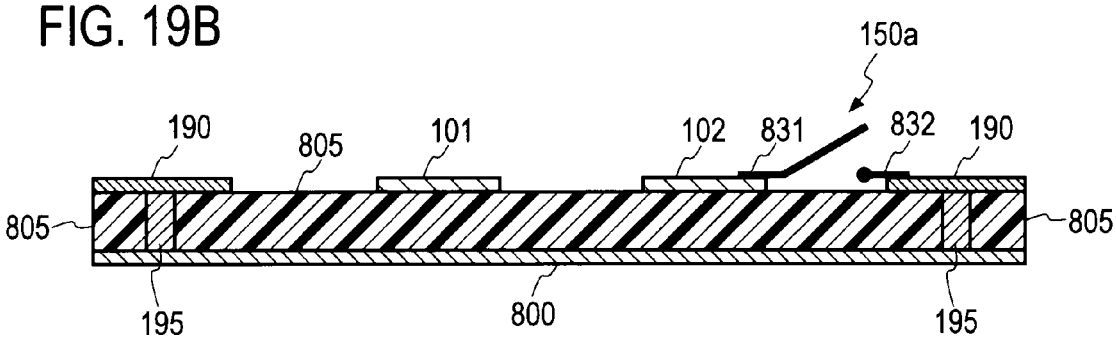
FIG. 19B is a cross-sectional view of the line structure shown in FIG. 19A taken along the line 19B-19B.

In the embodiments described above, exemplary configurations based on the microstrip line structure have been described. However, the present invention is not limited to the microstrip line structure but can be applied to other transmission line structures, such as a strip line structure, a coaxial line structure, a suspended microstrip line structure, a coplanar waveguide, a grounded coplanar waveguide and a slot line structure. As examples, FIGS. 18A and 18B show a variable resonator based on the coplanar waveguide structure, and FIGS. 19A and 19B show a variable resonator based on the grounded coplanar waveguide structure. FIG. 18B is a cross-sectional view of the variable resonator shown in FIG. 18A taken along the line 18B-18B, and FIG. 19B is a cross-sectional view of the variable resonator shown in FIG. 19A taken along the line 19B-19B. In the structure shown in FIGS. 18A and 18B, a grounding conductor 190 is formed on the same top surface of the dielectric substrate 805 as the two transmission lines 101 and 102. The structure shown in FIGS. 19A and 19B is the same as the structure shown in FIGS. 18A and 18B except that via holes 195 are additionally formed in the dielectric substrate 805 to connect the grounding conductor 800 on the back surface of the dielectric substrate 805 and the grounding conductor 190 on the top surface of the dielectric substrate 805 to each other (the reference numeral is affixed to only some of the via holes for the sake of clarity of the drawing).

Figure 20:
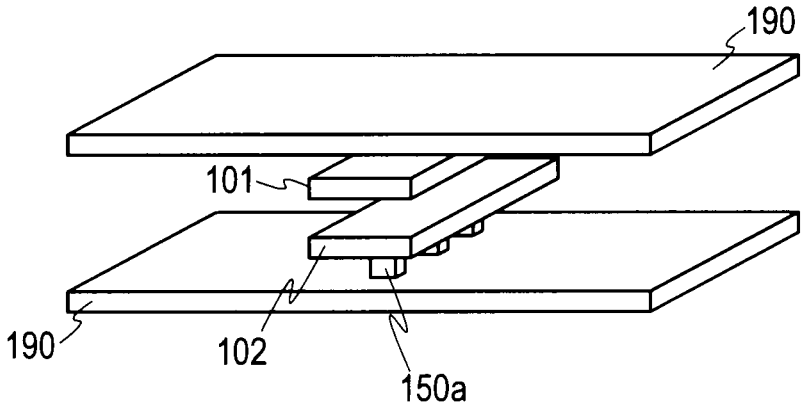
FIG. 20 shows an exemplary line structure for implementing the present invention.

FIG. 20 shows a structure in which a multilayer substrate is used, and the two transmission lines 101 and 102, which are formed in the same layer in the structure shown in FIGS. 1A and 1B, are formed in different layers so that the transmission lines are positioned one above the other (a dielectric fills the space between the grounding conductors 190, for example). This structure allows the dimension of the transmission lines 101 and 102 in the width direction to be reduced.

As described above, the variable resonator according to the present invention can be provided based on various structures other than the single-layer microstrip line structure shown in FIGS. 1A and 1B, and the variable resonator according to the present invention can be provided based on various structures other than the exemplary line structures described above as far as two transmission lines 101 and 102 having characteristic impedances for the even and odd modes that are uniform in the length direction of the transmission lines 101 and 102 can be used. This holds true for the variable filter described later.

Figure 21:
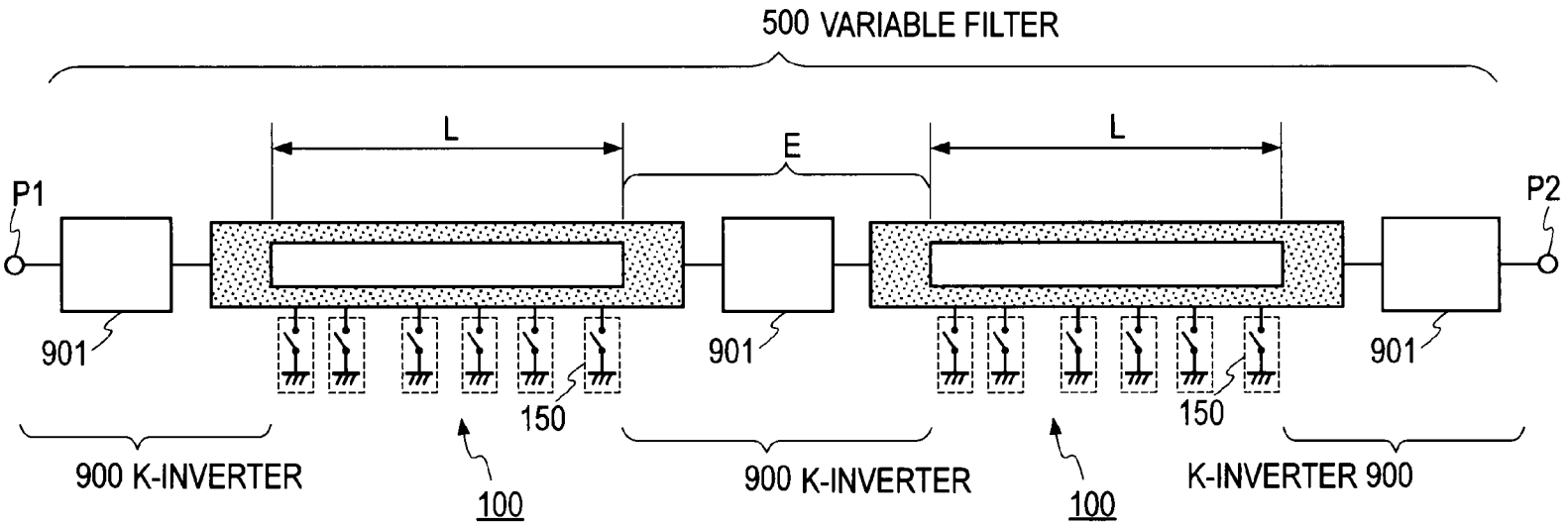
FIG. 21 is a plan view of a variable filter capable of changing the bandwidth.
Figure 22:
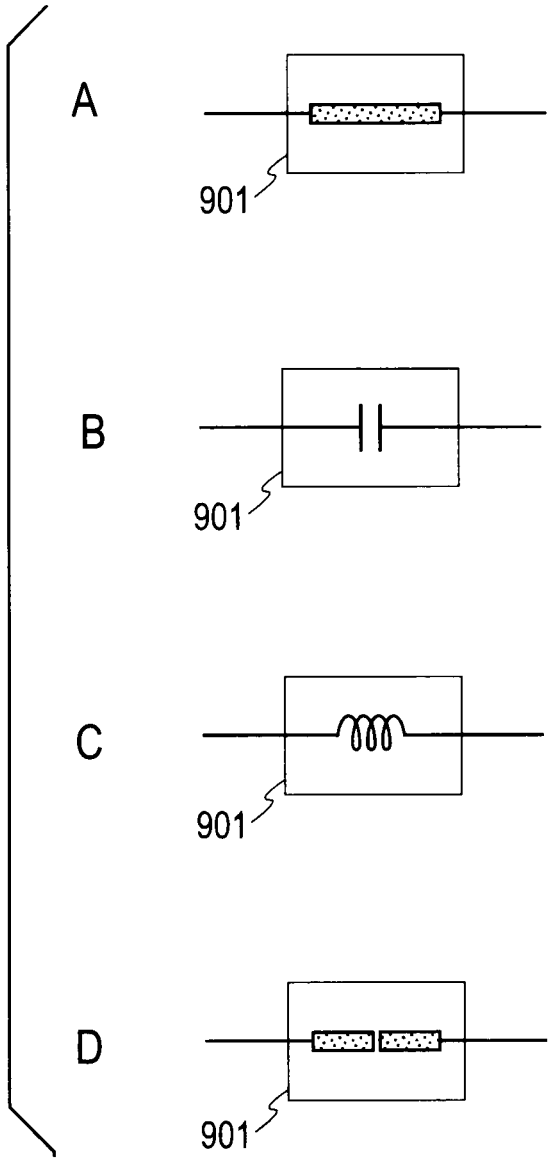
FIG. 22 shows specific examples of a circuit in a K-inverter.

Next, variable filters incorporating variable resonators according to the present invention according to embodiments of the present invention will be described. FIG. 21 shows a variable filter 500 comprising two variable resonators 100 shown in FIG. 1A and three K-inverters 900, in which the two variable resonators 100 and the three K-inverters 900 are alternately connected in series with one another between an input port P1 and an output port P2. The variable resonators 100 resonate at the same frequency. The K-inverter 900 is a circuit that provides a phase shift of 90° (a quarter wavelength) at an operating resonance frequency of the variable resonators 100. The phase shift of 90° is required between adjacent variable resonators 100 or, in other words, required by the circuit part formed by the output line of one variable resonator 100, one K-inverter 900 and the input line of another variable resonator 100 (the part denoted by reference character E in FIG. 21). Thus, in a strict sense, the K-inverter 900 that provides a phase shift of 90° includes the output line of one variable resonator 100 and the input line of another variable resonator 100. A circuit 901 included in the K-inverter 900 may be a quarter-wave line (FIG. 22(A)) at the resonance frequency of the variable resonator 100, a capacitor (FIG. 22(B)), an inductor (FIG. 22(C)) or a line with a gap (FIG. 22(D)) as shown in FIG. 22, although not limited thereto. Furthermore, although the K-inverter 900 has been described above as providing a phase shift of 90° at the resonance frequency, the phase shift may be an integral multiple of 90°.

In general, a band-pass filter can be formed by alternately connecting a plurality of resonators and a plurality of K-inverters in series with each other, and the variable filter 500 is a band-pass filter capable of changing the bandwidth. The central frequency of the variable filter 500 agrees with the resonance frequency of the variable resonator 100, and the bandwidth of the variable filter 500 can be changed by changing the position of the switch circuit 150 to be turned on in each variable resonator 100. Because of the property of the variable resonator 100 that the resonance frequency does not change when the bandwidth is changed, the central frequency of the variable filter 500 does not change when the bandwidth is changed. Although the variable resonator 100 shown in FIG. 1 is used as the variable resonators included in the variable filter 500 in this embodiment, any variable resonators capable of changing the bandwidth described in the above embodiments can be used. Furthermore, the numbers of the variable resonators and the K-inverters are not limited to those described in this embodiment.

Figure 23:
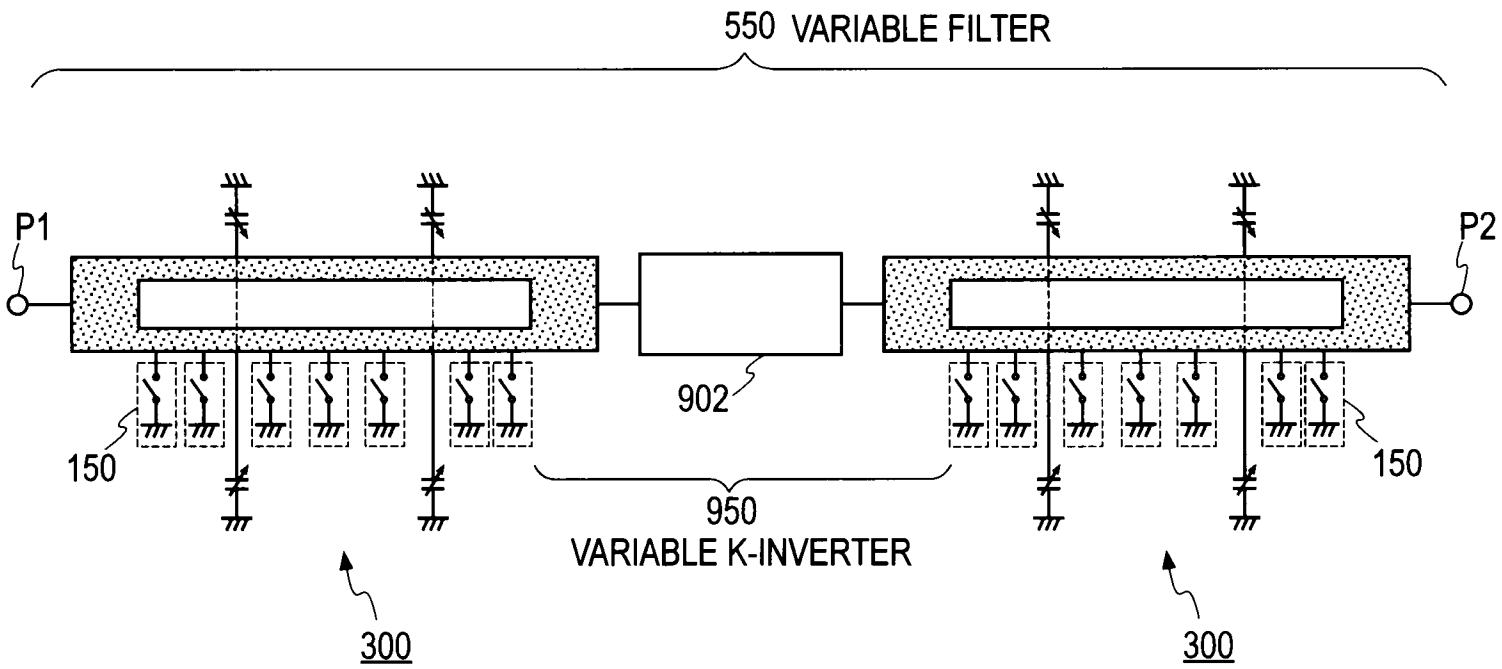
FIG. 23 is a plan view of a variable filter capable of changing the bandwidth and the central frequency.
Figure 24:
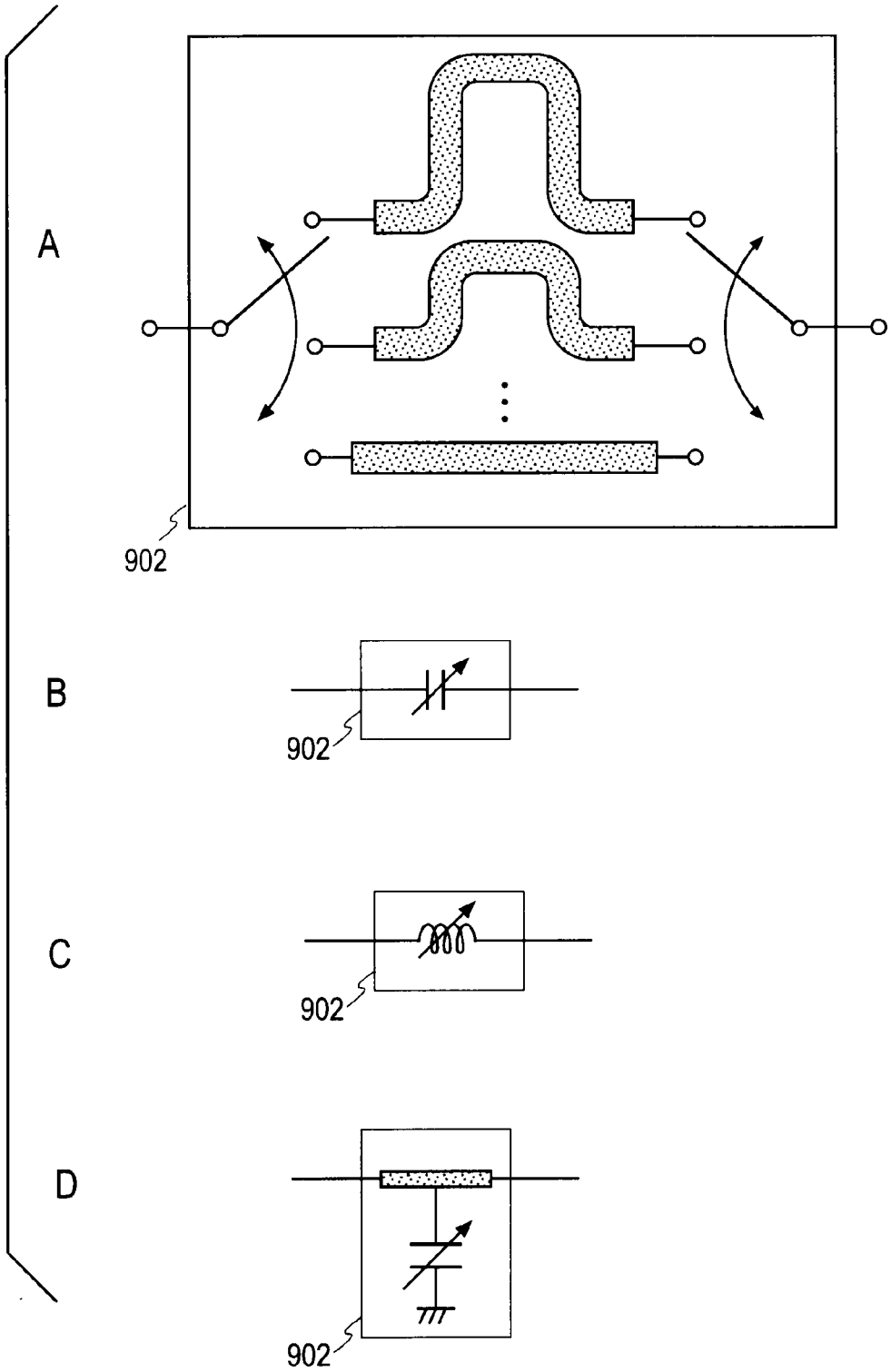
FIG. 24 shows specific examples of a circuit in a variable K-inverter.

FIG. 23 shows a variable filter 550, which is a modification of the variable filter 500. The variable filter 550 comprises two variable resonators 300 shown in FIG. 16 and one variable K-inverter 950, and the two variable resonators 300 and the variable K-inverter 950 are alternately connected in series with one another between an input port P1 and an output port P2. The variable resonators 300 resonate at the same frequency. Since the variable resonators 300 can change the resonance frequency, in order that the variable filter 550 is configured as a band-pass filter having a central frequency at the changed resonance frequency, the part denoted by reference character E in FIG. 21 has to be a K-inverter capable of changing the characteristics so that the phase shift is 90° after the resonance frequency of the variable resonators 300 is changed. To this end, the variable K-inverter 950 capable of changing the characteristics is used in the variable filter 550. A circuit 902 included in the variable K-inverter 950 may be a circuit that switches among lines having different line lengths (FIG. 24(A)), a variable capacitor (FIG. 24(B)), a variable inductor (FIG. 24(C)) or a transmission line loaded with a variable capacitor (FIG. 24(D)) as shown in FIG. 24, although not limited thereto.

The bandwidth of the variable filter 550 can be changed by changing the position of the switch circuit 150 to be turned on in each variable resonator 300. In addition, the central frequency of the variable filter 550 can be changed by changing the reactance of each variable reactance circuit in each variable resonator 300. Although the variable resonator 300 shown in FIG. 16 is used as the variable resonators included in the variable filter 550 in this embodiment, any variable resonators capable of changing the resonance frequency and the bandwidth described in the above embodiments can be used. Furthermore, the numbers of the variable resonators and the variable K-inverters are not limited to those described in this embodiment.

Figure 25:
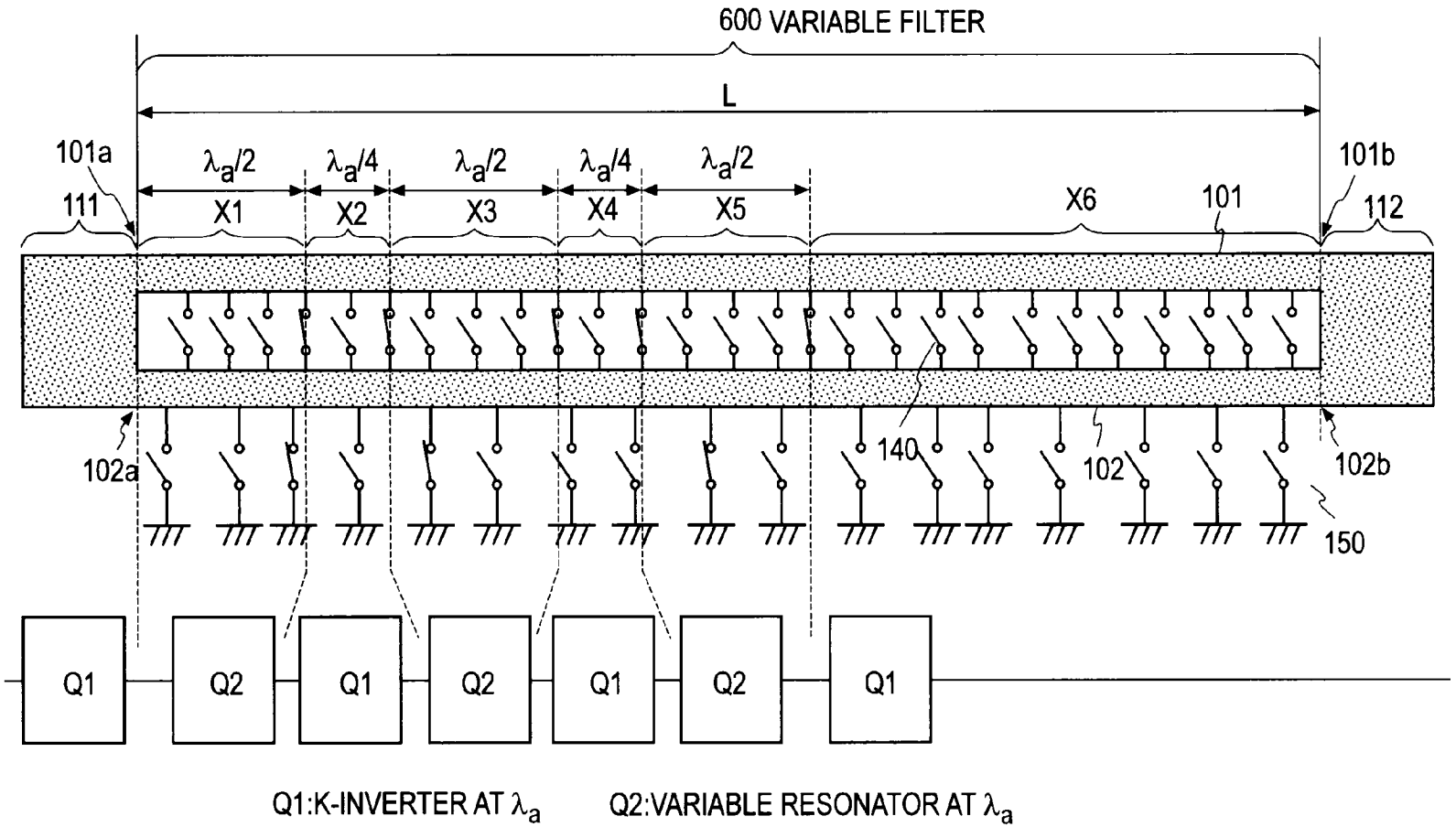
FIG. 25 is a plan view of a variable filter capable of changing the bandwidth, the central frequency and the number of stages.

Next, a variable filter according to an embodiment of the present invention will be described. FIG. 25 shows a variable filter 600 that has a configuration similar to the variable resonator 200 shown in FIGS. 13A, 13B and 13C. The variable filter 600 differs from the variable resonator 200 in which of a plurality of switches 140 in the variable resonator 200 are selected to be turned on. Thus, a functional configuration of the variable filter 600 will be described below.

FIG. 25 shows a case where five of twenty seven switches 140 of the variable filter 600, specifically, the fourth, sixth, tenth, twelfth and sixteenth switches 140 from the input line 111, are turned on, and the variable filter 600 functions as a three-stage band-pass filter having a central frequency corresponding to a wavelength of $\lambda_a$. More specifically, in order to make the variable filter 600 function as a three-stage band-pass filter having a central frequency corresponding to a wavelength $\lambda_a$, the switches 140 at positions distant from the one end 102*a* of the second transmission line 102 by $\lambda_a/2$, $3\lambda_a/4$, $5\lambda_a/4$, $3\lambda_a/2$ and $2\lambda_a$ are turned on in this example.

One switch circuit 150 is turned on in each of the line sections (having a line length of $\lambda_a/2$) denoted by reference characters X1, X3 and X5 in FIG. 25, so that the line sections operate as a variable resonator that has a resonance frequency corresponding to the wavelength $\lambda_a$.

The input line 111 is typically designed to have a line length equal to or greater than $\lambda_a/4$ but, here, the input line 111 in this example has a line length of L (FIG. 25 shows only a part of the input line 111). An end portion of the input line 111 having a line length of $\lambda_a/4$ functions as a K-inverter, and the remaining portion having a line length of L-$\lambda_a/4$ functions as a normal transmission line.

All the switch circuits 150 are turned off in each of the line sections (having a line length of $\lambda_a/4$) denoted by reference characters X2 and X4 in FIG. 25, so that the line sections function as a normal transmission line.

All the switch circuits 150 are turned off in the line section (having a line length of L-$2\lambda_a$) denoted by reference character X6 in FIG. 25, so that an end portion of the line section X6 closer to the input line 111 having a line length of $\lambda_a/4$ functions as a K-inverter, and the remaining portion of the line section X6 having a line length of L-$9\lambda_a/4$ functions as a normal transmission line. The output line 112 also functions as a normal transmission line.

FIG. 25 shows functional blocks Q1 and Q2 equivalent to those of the variable filter 600 along with the functional configuration of the variable filter 600. That is, the variable filter 600 is a three-stage band-pass filter formed by alternately coupling three blocks Q2 corresponding to the variable resonators in the sections denoted by reference characters X1, X3 and X5 and four blocks Q1 corresponding to the K-inverter that is a portion of the input line 111, the K-inverters in the sections denoted by reference characters X2 and X4 and the K-inverter that is a portion of the section denoted by reference character X6. As can be seen, a band-pass filter can be provided by appropriately selecting the switch circuits 150 and the switches 140 to be turned on.

The variable filter 600 can change the bandwidth independently of the central frequency corresponding to the wavelength $\lambda_a$ by changing the switch circuits 150 to be turned on in each variable resonator (X1, X3, X5). If the fourth, sixth and tenth switches 140 from the input line 111 are turned on (the twelfth and sixteenth switches 140 are turned off), a two-stage band-pass filter is provided while maintaining the central frequency. In this way, the number of stages can be changed independently. The central frequency of the variable filter 600 depends on the positions of the switches 140 to be turned on. This will be described with reference to FIG. 26.

Figure 26:
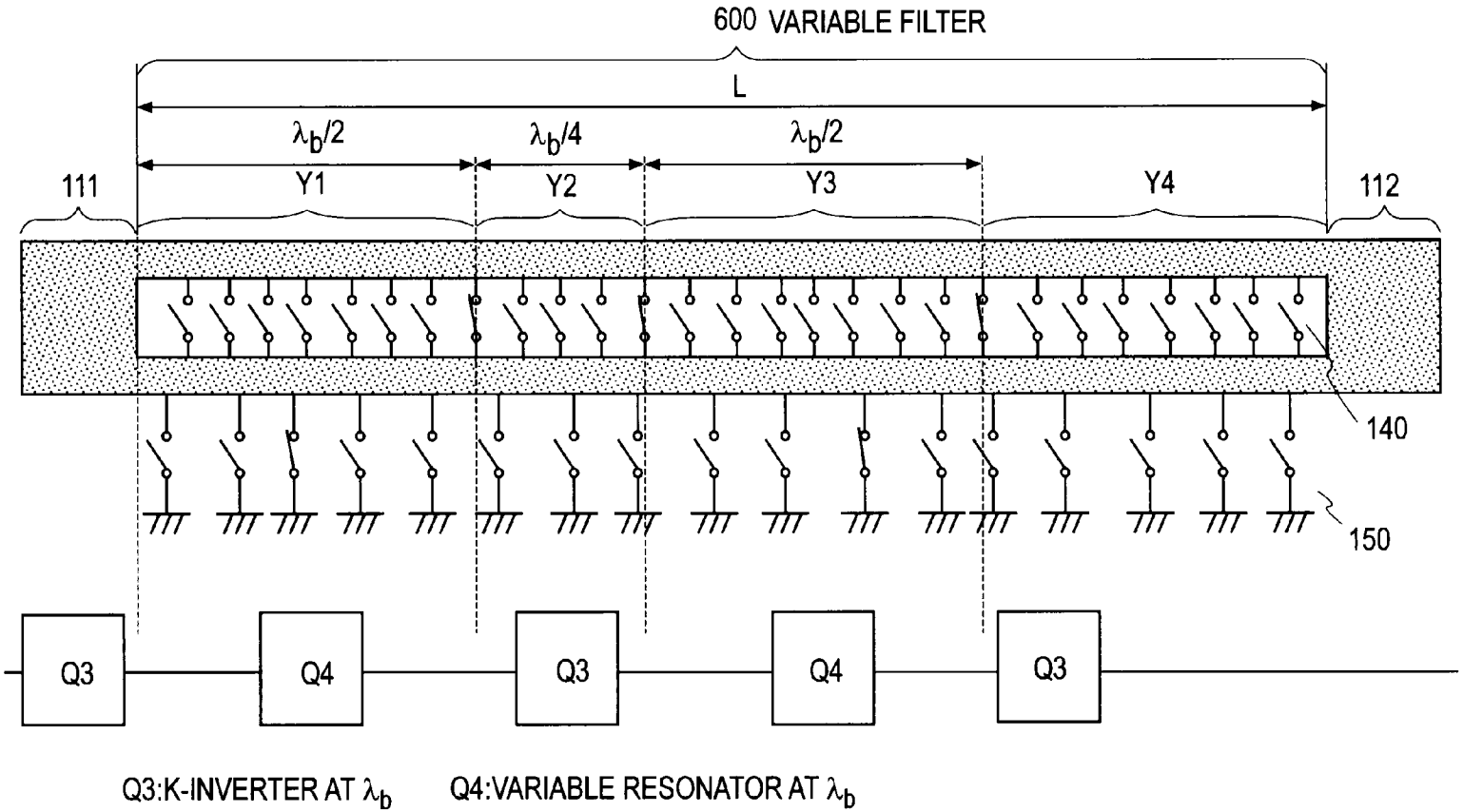
FIG. 26 is a plan view of a variable filter capable of changing the bandwidth, the central frequency and the number of stages.

The variable filter 600 shown in FIG. 26 is the same as the variable filter 600 shown in FIG. 25 except for the positions of the switches 140 turned on. In the functional configuration shown in FIG. 26, three switches 140, specifically, the eighth, twelfth and twentieth switches 140 from the input line 111, are turned on, and the variable filter 600 functions as a two-stage band-pass filter having a central frequency corresponding to a wavelength of $\lambda_b$ ($>\lambda_a$). More specifically, in order to make the variable filter 600 function as a two-stage band-pass filter having a central frequency corresponding to a wavelength $\lambda_b$, the switches 140 at positions distant from the one end 102*a* of the second transmission line 102 by $\lambda_b/2$, $3\lambda_b/4$ and $5\lambda_b/4$ are turned on in this example.

One switch circuit 150 is turned on in each of the line sections (having a line length of $\lambda_b/2$) denoted by reference characters Y1 and Y3 in FIG. 26, so that the line sections Y1 and Y3 each operate as a variable resonator that has a resonance frequency corresponding to the wavelength $\lambda_b$.

The line portion of the input line 111 having a line length of $\lambda_b/4$ functions as a K-inverter, and the remaining portion having a line length of L-$\lambda_b/4$ functions as a normal transmission line.

All the switch circuits 150 are turned off in the line section (having a line length of $\lambda_b/4$) denoted by reference character Y2 in FIG. 26, so that the line section function as a normal transmission line.

All the switch circuits 150 are turned off in the line section (having a line length of L-$5\lambda_b/4$) denoted by reference character Y4 in FIG. 26, so that the portion of the line section Y4 closer to the input line 111 having a line length of $\lambda_b/4$ functions as a K-inverter, and the remaining portion of the line section Y4 having a line length of L-$3\lambda_b/2$ functions as a normal transmission line. The output line 112 also functions as a normal transmission line.

FIG. 26 shows functional blocks Q3 and Q4 equivalent to those of the variable filter 600 along with the functional configuration of the variable filter 600. That is, the variable filter 600 is a two-stage band-pass filter formed by alternately coupling two blocks Q4 corresponding to the variable resonators in the sections denoted by reference characters Y1 and Y3 and three blocks Q3 corresponding to the K-inverter that is a part of the input line 111, the K-inverter in the section denoted by reference character Y2 and the K-inverter that is a part of the section denoted by reference character Y4. Even with the functional configuration shown in FIG. 26, the variable filter 600 can change the bandwidth independently of the central frequency corresponding to the wavelength $\lambda_b$ by changing the switch circuits 150 to be turned on in each variable resonator (Y1, Y3). Furthermore, in general, even with the functional configuration shown in FIG. 26, the gradient of the rising and falling edges of the characteristics can be changed by only changing the number of stages.

As described above, the variable filter 600 can change the central frequency, the bandwidth and the number of filter stages by changing the positions of the switches 140 to be turned on and the positions of the switch circuits 150 to be turned on.

Figure 27:
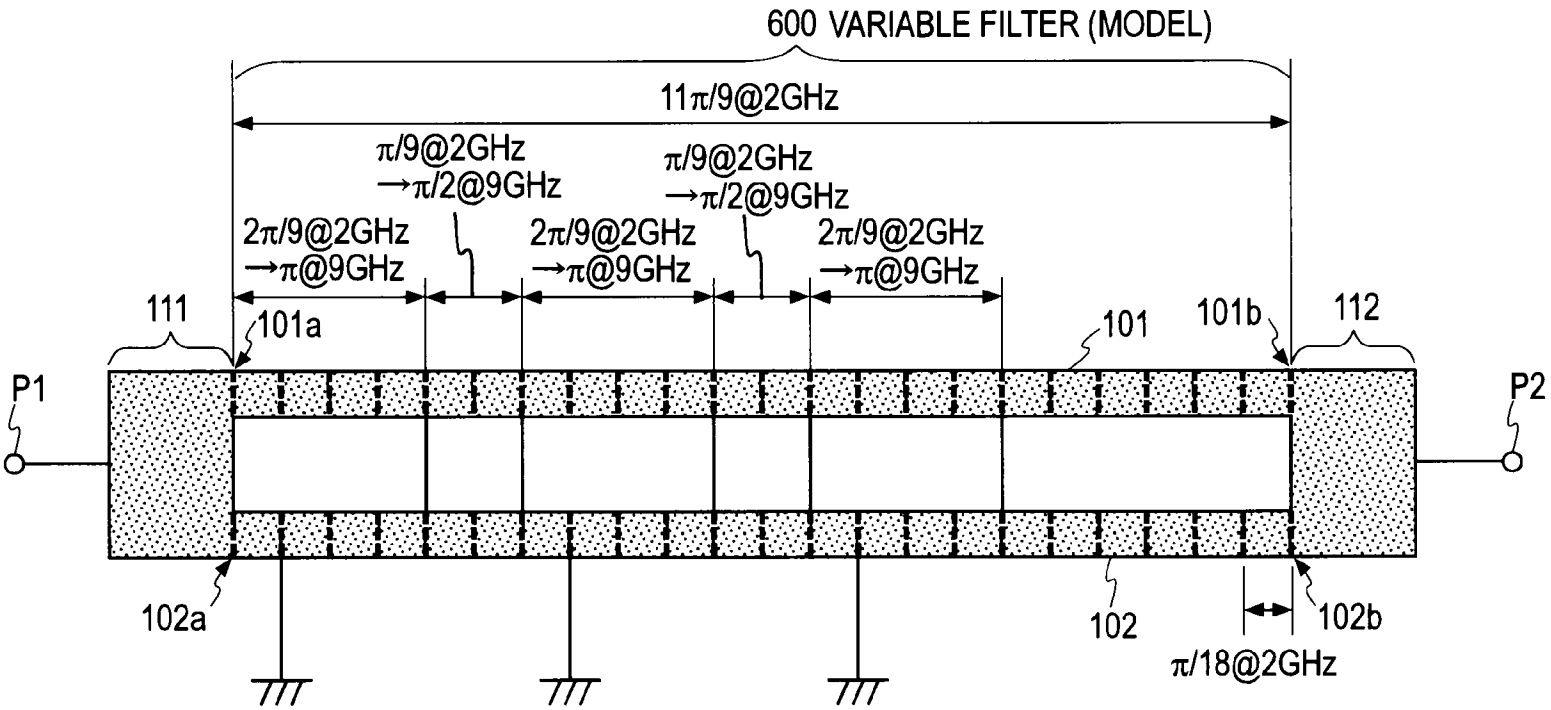
FIG. 27 shows a model of the variable filters shown in FIGS. 25 and 26 used for circuit simulation.
Figure 28:
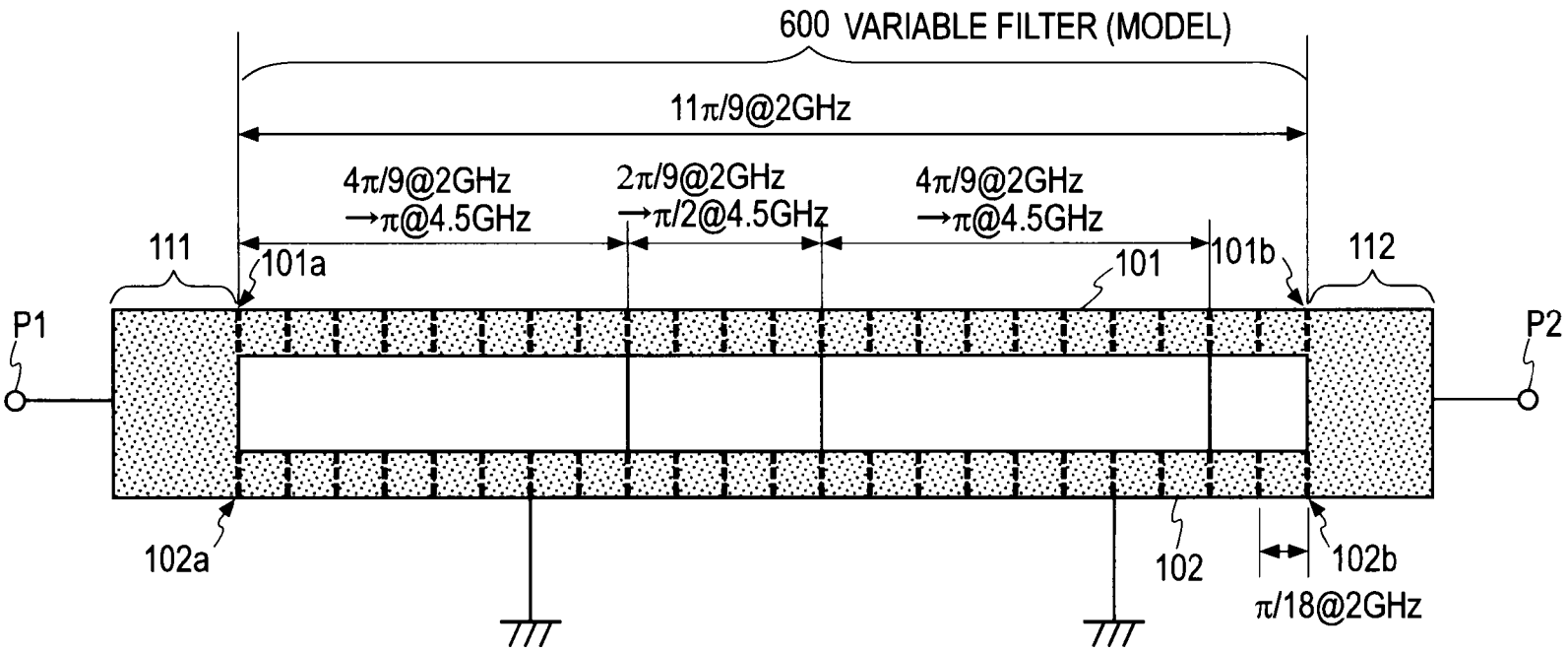
FIG. 28 shows a model of the variable filters shown in FIGS. 25 and 26 used for circuit simulation.

FIGS. 27 and 28 show models used for determining the characteristics of the variable filter 600 by simulation. It is assumed that the two transmission lines 101 and 102 are electromagnetically coupled to each other, the characteristic impedance for the even mode of the first transmission line 101 is 100Ω, the characteristic impedance for the odd mode of the first transmission line 101 is 50Ω, the characteristic impedance for the even mode of the second transmission line 102 is 100Ω, and the characteristic impedance for the odd mode of the second transmission line 102 is 50Ω. It is also assumed that the two transmission lines 101 and 102 have a line length equivalent to an electrical length of 220° (11π/9 rad) at 2 GHz. Each of the rectangular sections of the transmission lines 101 and 102 defined by broken lines has an electrical length of 10°.

Figure 29A:
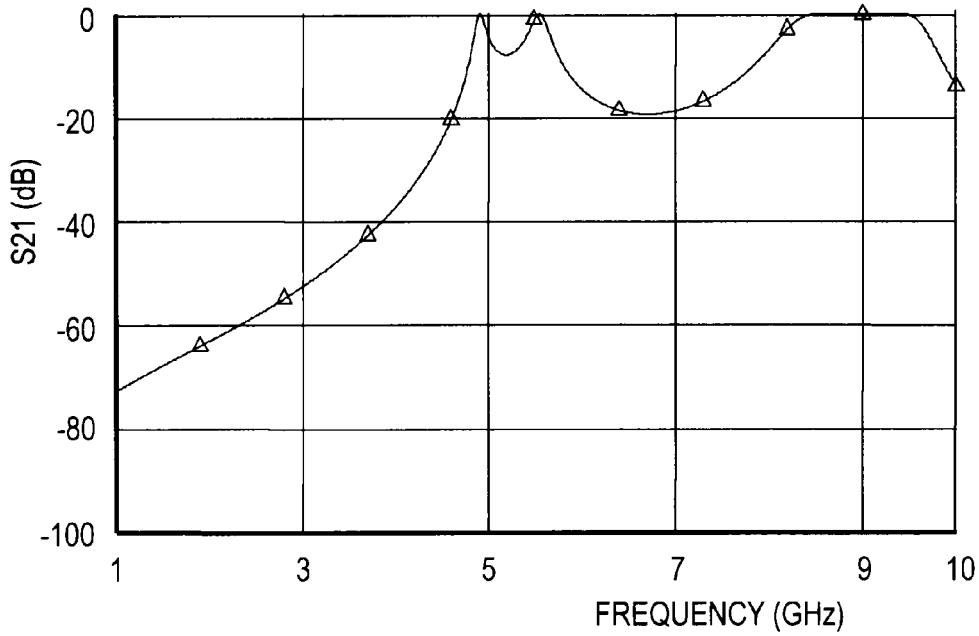
FIG. 29A shows frequency characteristics of the model shown in FIG. 27.

FIG. 27 shows a model of the variable filter 600 in a case where the switches 140 turned on are switches 140 distant from the one end 101*a* or 102*a* by electrical lengths of 40°, 60°, 100°, 120° and 140° at 2 GHz. The switch circuits 150 turned on are switch circuits 150 distant from the one end 101*a* or 102*a* by electrical lengths of 10°, 70° and 130° at 2 GHz. In this case, a section formed by lines having an electrical length of 40° (2π/9 rad) at 2 GHz operates as a resonator at 9 GHz, and a section formed by lines having an electrical length of 20° at 2 GHz operates as a K-inverter at 9 GHz. Therefore, the model of the variable filter 600 shown in FIG. 27 is a three-stage band-pass filter having a central frequency of 9 GHz. FIG. 29A shows frequency characteristics of the transmission coefficient S21 of the model shown in FIG. 27, showing characteristics of the band-pass filter having a pass band around 9 GHz.

Figure 29B:
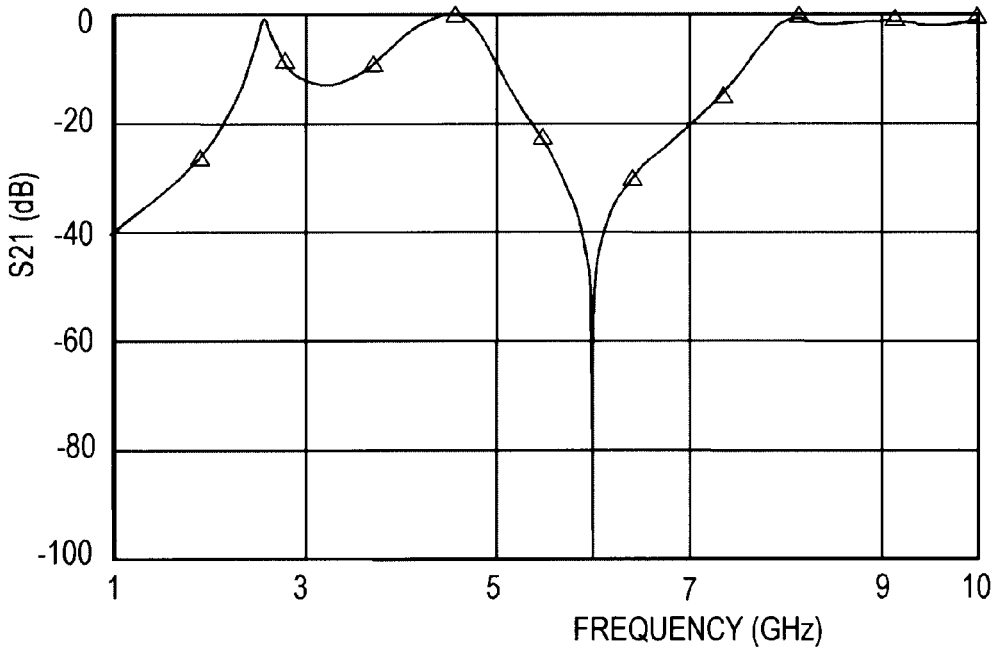
FIG. 29B shows frequency characteristics of the model shown in FIG. 28.

FIG. 28 shows a model of the variable filter 600 in a case where the switches 140 turned on are switches 140 distant from the one end 101*a* or 102*a* by electrical lengths of 80°, 120° and 200° at 2 GHz. The switch circuits 150 turned on are switch circuits 150 distant from the one end 101*a* or 102*a* by electrical lengths of 60° and 180° at 2 GHz. In this case, a section formed by lines having an electrical length of 80° (4π/9 rad) at 2 GHz operates as a resonator at 4.5 GHz, and a section formed by lines having an electrical length of 40° at 2 GHz operates as a K-inverter at 4.5 GHz. Therefore, the model of the variable filter 600 shown in FIG. 28 is a two-stage band-pass filter having a central frequency of 4.5 GHz. FIG. 29B shows frequency characteristics of the transmission coefficient S21 of the model shown in FIG. 28, showing characteristics of the band-pass filter having a pass band around 4.5 GHz. Thus, it is confirmed that the variable filter 600 is a filter capable of changing the central frequency, the bandwidth and the number of stages.

Not only the bandwidth but also other characteristic functions, such as maximally flat characteristics (Butterworth characteristics) and Chebyshev characteristics, can be changed by appropriately changing the combination of the positions of the switch circuits 150 to be turned on.

The variable filter 600 according to this embodiment is based on the variable resonator 200 shown in FIG. 10. However, a variable filter capable of changing characteristics by selecting switches 140 to be turned on from among a plurality of switches 140 can be provided based not only on the variable resonator 200 but also on the variable resonator 400 having a plurality of switches 140 shown in FIG. 17, for example. In this case, the number and positions of the reactance circuits connected to the line section operating as a variable resonator in the variable filter have to meet the conditions described above with regard to the variable resonators 300 and 400. In addition, the characteristic impedances for the even and odd modes of the two transmission lines 101 and 102 ideally meet the conditions described above.

A configuration of a variable filter 600 will be generally described based on the configuration of the variable resonator 200 shown in FIG. 10. That is, R switches $S_r$ (r=1, 2, . . . , R) are connected between the first transmission line 101 and the second transmission line 102 of the variable filter 600 at intervals to divide the transmission lines into sections in the length direction (reference character R denotes an integer equal to or greater than 2). The electrical length between the point of connection of one end of the r-th switch $S_r$ to the first transmission line 101 and the one end 101*a* of the first transmission line 101 is equal to the electrical length between the point of connection of the other end of the switch $S_r$ to the second transmission line 102 and the one end 102*a* of the second transmission line 102. Depending on the positions of connection of two or more switches $S_r$ to be turned on, two or more sections having a line length of a half wavelength at the same operating frequency and at least one section having a line length of a quarter wavelength at the operating frequency are alternately arranged in the length direction of the transmission lines 101 and 102. In each of the sections having a line length of a half wavelength, at least one switch circuit 150 is connected to the first transmission line 101 or the second transmission line 102, and only one of the switch circuits 150 is turned on. In each of the sections having a line length of a quarter wavelength, no switch circuit 150 is turned on.

Next, a configuration of a variable filter 600 will be generally described based on the configuration of the variable resonator 400 having a plurality of switches 140 shown in FIG. 17. That is, the variable filter 600 based on the variable resonator 200 generally described above further has $M_x$ reactance circuits $C_{mx}$ (mx=1, 2, . . . , $M_x$) in at least one of the sections $I_x$ having a line length of a half wavelength. And provided that $L_x$ represents the half wavelength, $M_x$ represents an even number equal to or greater than 4 predetermined for the section $I_x$, and mx represents an integer equal to or greater than 1 and equal to or smaller than $M_x$, the reactance circuits $C_{mx}$ falling within a range $1 \leq mx \leq M_x/2$ are connected to the first transmission line 101 at positions distant from the end of the section $I_x$ closer to the input line 111 by $L_x(2m-1)/M_x$, and the reactance circuits $C_{mx}$ falling within a range $M_x/2 < mx \leq M_x$ are connected to the second transmission line 102 at positions distant from the end of the section $I_x$ closer to the input line 111 by $L_x(2m-M_x-1)/M_x$.

The switch circuits 150 in the variable filter can have the configurations shown in FIG. 6, and the switches 150*a* in the switch circuits 150 can have the configurations shown in FIG. 7. Furthermore, as with the variable resonator described above, the variable filter according to the present invention can also be provided based on various line structures other than the microstrip line structure, such as a strip line structure, a coaxial line structure, a suspended microstrip line structure, a coplanar waveguide, a grounded coplanar waveguide and a slot line structure.

The variable resonators 100, 200, 300 and 400 and the variable filter 600 in the above embodiments can function not only as a resonator or a filter but also as a transmission line when all the switches 140 and the all the switch circuits 150 are turned off. In particular, when the variable resonators 200, 300 and 400 have one switch circuit 150, the circuit elements denoted by reference numerals 200, 300 and 400 do not function as a variable resonator capable of changing the bandwidth and the resonance frequency but are multirole circuit elements that function as a transmission line when the switch circuit 150 is turned off and function as a resonator having a certain bandwidth capable of changing the resonance frequency when the switch circuit 150 is turned on.

In the case where the variable filter 600 is made to function as a variable filter having a fixed central frequency, only one switch circuit 150 is needed in each line section functioning as a resonator at the central frequency. Therefore, in this case, the circuit element denoted by reference numeral 600 is a multirole circuit element that functions as a transmission line when all the switch circuits 150 are turned off and functions as a resonator having a certain bandwidth capable of changing the number of stages when a number of switch circuits 150 are turned on depending on the number of stages.

As is apparent from the embodiments, the circuit elements, the variable resonators and the variable filters according to the present invention can be formed by transmission lines, switches, reactance circuits and the like and therefore can be easily fabricated.

In addition, the circuit elements, the variable resonators and the variable filters according to the present invention have shapes similar to a common transmission line and therefore can be placed between devices, such as an amplifier and an antenna, to replace a transmission line. Thus, the present invention advantageously has an extremely high flexibility of placement.

In the embodiments, control over the switches 140 and the switch circuits 150 may be required. In such a case, the control can be achieved by applying a control signal to the switches 140 and the switch circuits 150. However, means for achieving the control can be implemented by a well-known technique, and detailed descriptions thereof will be omitted. For the same reason, the means for achieving the control is not shown in the drawings.

Although embodiments of the present invention have been described, the present invention is not limited to the embodiments described above and can be appropriately modified without departing from the spirit of the present invention.

What is claimed is:

1. A multirole circuit element, comprising:

a first transmission line connected at one end and the other end thereof to an input line and an output line, respectively a second transmission line having an electrical length equal to an electrical length of said first transmission line and connected at one end and the other end thereof to said input line and said output line, respectively; and one or more switch circuits, wherein a characteristic impedance for an even mode and a characteristic impedance for an odd mode of said first transmission line are uniform in a length direction of said first transmission line, a characteristic impedance for an even mode and a characteristic impedance for an odd mode of said second transmission line are uniform in a length direction of said second transmission line, the characteristic impedance for the even mode of said first transmission line is equal to the characteristic impedance for the even mode of said second transmission line, the characteristic impedance for the odd mode of said first transmission line is equal to the characteristic impedance for the odd mode of said second transmission line, and each of said one or more switch circuits is connected to only either one of said first transmission line and said second transmission line at a point thereon except for said one end and the other end thereof, thereby allowing the multirole circuit element to be capable of selectively operating as any one of at least a resonator and a transmission line depending on an on/off state of said one or more switch circuits.

2. The multirole circuit element according to claim 1, wherein a line length of said first transmission line is equal to a line length of said second transmission line, a line width of said first transmission line is equal to a line width of said second transmission line, and a distance between said first transmission line and said second transmission line is uniform.

3. The multirole circuit element according to claim 1 or 2, wherein, provided that reference character R represents a predetermined integer equal to or greater than 1, and reference character r represents an integer equal to or greater than 1 and equal to or smaller than R, the multirole circuit element further comprises R switches $S_r$, where r =1, 2, . . . , R, and an r-th switch $S_r$ is connected at one end thereof to said first transmission line and to said second transmission line at another end, and an electrical length between the point of connection of said one end of said switch $S_r$ to said first transmission line and said one end of said first transmission line is equal to an electrical length between the point of connection of said another end of said switch $S_r$ to said second transmission line and said one end of said second transmission line.

4. The multirole circuit element according to claim 1 or 2, wherein, provided that reference character M represents a predetermined even number equal to or greater than 4, reference character m represents an integer equal to or greater than 1 and equal to or smaller than M, and reference character L denotes the line length of said first transmission line and the line length of said second transmission line, the multirole circuit element further comprises M reactance circuits $C_m$, where m=1, 2, . . . , M, a reactance circuit $C_m$falling within a range $1 \leq m \leq M/2$ is connected to said first transmission line at a position distant from said one end of said first transmission line by $L(2m-1)/M$, and a reactance circuit $C_m$ falling within a range $M/2 \leq m \leq M$ is connected to said second transmission line at a position distant from said one end of said second transmission line by $L(2m-M-1)/M$.

5. The multirole circuit element according to claim 3, wherein, said first and second transmission lines are divided by the points of connection of said R switches $S_r$ into R+1 sections $I_x$, where x=1, 2, . . . , R+1, the sections $I_x$ of said first and second transmission lines have an equal electrical length $L_x$, $M_x$ reactance circuits $C_{mx}$ are provided for at least one section $I_x$, where reference character $M_x$ represents an even number equal to or greater than 4, and mx=1, 2, . . . , $M_x$, a reactance circuit $C_{mx}$ falling within a range $1 \leq mx \leq M_x/2$ is connected to said first transmission line at a position distant from an end of said section $I_x$ closer to said input line by $L_x(2mx-1)/M_x$, and a reactance circuit $C_{mx}$ falling within a range $M_x/2 \leq mx \leq M_x$ is connected to said second transmission line at a position distant from an end of said section $I_x$ closer to said input line by $L_x(2m-M_x-1)/M_x$.

6. The multirole circuit element according to claim 4, wherein each of said M reactance circuits $C_m$ is a circuit capable of changing a reactance.

7. The multirole circuit element according to claim 5, wherein each of said reactance circuits $C_{mx}$ is a circuit capable of changing a reactance.

8. The multirole circuit element according to claim 1 or 2, wherein said characteristic impedance for the even mode is twice as high as a characteristic impedance of said input line and said output line.

9. The multirole circuit element according to claim 1, wherein the multirole circuit element comprises a plurality of said switch circuits and is configured to be capable of operating as a variable resonator capable of changing a bandwidth when one of said plurality of switch circuits is selectively turned on.

10. The multirole circuit element according to claim 9, wherein a line length of said first transmission line is equal to a line length of said second transmission line, a line width of said first transmission line is equal to a line width of said second transmission line, and a distance between said first transmission line and said second transmission line is uniform.

11. The multirole circuit element according to claim 9 or 10, wherein, provided that reference character R represents a predetermined integer equal to or greater than 1, and reference character r represents an integer equal to or greater than 1 and equal to or smaller than R, the multirole circuit element further comprises R switches $S_r$, where r=1, 2, . . . , R, and an r-th switch $S_r$ is connected at one end thereof to said first transmission line and at another end to said second transmission line, and an electrical length between the point of connection of said one end of said switch $S_r$ to said first transmission line and said one end of said first transmission line is equal to an electrical length between the point of connection of said another end of said switch $S_r$ to said second transmission line and said one end of said second transmission line.

12. The multirole circuit element according to claim 9 or 10, wherein, provided that reference character M represents a predetermined even number equal to or greater than 4, reference character m represents an integer equal to or greater than 1 and equal to or smaller than M, and reference character L denotes the line length of said first transmission line and the line length of said second transmission line, the multirole circuit element further comprises M reactance circuits $C_m$, where m=1, 2, . . . , M, a reactance circuit $C_m$ falling within a range $1 \leq m \leq M/2$ is connected to said first transmission line at a position distant from said one end of said first transmission line by $L(2m-1)/M$, and a reactance circuit $C_m$ falling within a range $M/2 \leq m \leq M$ is connected to said second transmission line at a position distant from said one end of said second transmission line by $L(2m-M-1)/M$.

13. The multirole circuit element according to claim 11, wherein said first and second transmission lines are divided by the points of connection of said R switches $S_r$ into R+1 sections $I_x$, where x=1, 2, . . . , R+1, the sections $I_x$ of said first and second transmission lines have an equal electrical length $L_x$, $M_x$ reactance circuits $C_{mx}$ are provided for at least one section $I_x$, where reference character $M_x$ represents an even number equal to or greater than 4, and mx=1, 2, . . . , $M_x$, and a reactance circuit $C_{mx}$ falling within a range $1 \leq mx \leq M_x/2$ is connected to said first transmission line at a position distant from an end of said section $I_x$ closer to said input line by $L_x(2mx-1)/M_x$, and a reactance circuit $C_{mx}$ falling within a range $M_x/2 \leq mx \leq M_x$ is connected to said second transmission line at a position distant from an end of said section $I_x$ closer to said input line by $L_x(2mx-M-1)/M_x$.

14. The multirole circuit element according to claim 12, wherein each of said M reactance circuits $C_m$ is a circuit capable of changing a reactance.

15. The multirole circuit element according to claim 13, wherein each of said reactance circuits $C_{mx}$ is a circuit capable of changing a reactance.

16. The multirole circuit element according to claim 9 or 10, wherein said characteristic impedance for the even mode is twice as high as a characteristic impedance of said input line and said output line.

17. A variable filter, comprising:

a plurality of multirole circuit elements according to claim 9 or 10; and a K-inverter connected in series between adjacent two of said multirole circuit elements.

18. A multirole circuit element, comprising:

a first transmission line connected at one end thereof to an input line and at another end to an output line;

a second transmission line having an electrical length equal to an electrical length of said first transmission line and connected at one end thereof to said input line and at another end to said output line; and one or more switch circuits, wherein a characteristic impedance for an even mode and a characteristic impedance for an odd mode of said first transmission line are uniform in a length direction of said first transmission line, a characteristic impedance for an even mode and a characteristic impedance for an odd mode of said second transmission line are uniform in a length direction of said second transmission line, the characteristic impedance for the even mode of said first transmission line is equal to the characteristic impedance for the even mode of said second transmission line, the characteristic impedance for the odd mode of said first transmission line is equal to the characteristic impedance for the odd mode of said second transmission line, and each of said one or more switch circuits is connected to either said first transmission line or said second transmission line and is capable of selectively operating as any one of at least a resonator and a transmission line depending on an on/off state of said one or more switch circuits;

wherein, provided that reference character M represents a predetermined even number equal to or greater than 4, reference character m represents an integer equal to or greater than 1 and equal to or smaller than M, and reference character L denotes the line length of said first transmission line and the line length of said second transmission line, the multirole circuit element further comprises M reactance circuits $C_m$, where m=1, 2, . . . , M, a reactance circuit $C_m$ falling within a range $1 \geq m \leq M/2$ is connected to said first transmission line at a position distant from said one end of said first transmission line by L(2m−1)/M, and a reactance circuit $C_m$ falling within a range M/2 m M is connected to said second transmission line at a position distant from said one end of said second transmission line by L(2m−M−1)/M.

19. A multirole circuit element, comprising:

a first transmission line connected at one end thereof to an input line and at another end to an output line;

a second transmission line having an electrical length equal to an electrical length of said first transmission line and connected at one end thereof to said input line and at another end to said output line; and one or more switch circuits, wherein a characteristic impedance for an even mode and a characteristic impedance for an odd mode of said first transmission line are uniform in a length direction of said first transmission line, a characteristic impedance for an even mode and a characteristic impedance for an odd mode of said second transmission line are uniform in a length direction of said second transmission line, the characteristic impedance for the even mode of said first transmission line is equal to the characteristic impedance for the even mode of said second transmission line, the characteristic impedance for the odd mode of said first transmission line is equal to the characteristic impedance for the odd mode of said second transmission line, and each of said one or more switch circuits is connected to either said first transmission line or said second transmission line and is capable of selectively operating as any one of at least a resonator and a transmission line depending on an on/off state of said one or more switch circuits;

wherein said characteristic impedance for the even mode is twice as high as a characteristic impedance of said input line and said output line.

20. A multirole circuit element, comprising:

a first transmission line connected at one end thereof to an input line and at another end to an output line;

a second transmission line having an electrical length equal to an electrical length of said first transmission line and connected at one end thereof to said input line and at another end to said output line; and one or more switch circuits, wherein a characteristic impedance for an even mode and a characteristic impedance for an odd mode of said first transmission line are uniform in a length direction of said first transmission line, a characteristic impedance for an even mode and a characteristic impedance for an odd mode of said second transmission line are uniform in a length direction of said second transmission line, the characteristic impedance for the even mode of said first transmission line is equal to the characteristic impedance for the even mode of said second transmission line, the characteristic impedance for the odd mode of said first transmission line is equal to the characteristic impedance for the odd mode of said second transmission line, and each of said one or more switch circuits is connected to either said first transmission line or said second transmission line and is capable of selectively operating as any one of at least a resonator and a transmission line depending on an on/off state of said one or more switch circuits;

wherein the multirole circuit element comprises a plurality of said switch circuits and is configured to be capable of operating as a variable resonator capable of changing a bandwidth when one of said plurality of switch circuits is selectively turned on.

21. A multirole circuit element, comprising:

a first transmission line connected at one end thereof to an input line and at another end to an output line;

a second transmission line having an electrical length equal to an electrical length of said first transmission line and connected at one end thereof to said input line and at another end to said output line; and one or more switch circuits, wherein a characteristic impedance for an even mode and a characteristic impedance for an odd mode of said first transmission line are uniform in a length direction of said first transmission line, a characteristic impedance for an even mode and a characteristic impedance for an odd mode of said second transmission line are uniform in a length direction of said second transmission line, the characteristic impedance for the even mode of said first transmission line is equal to the characteristic impedance for the even mode of said second transmission line, the characteristic impedance for the odd mode of said first transmission line is equal to the characteristic impedance for the odd mode of said second transmission line, and each of said one or more switch circuits is connected to either said first transmission line or said second transmission line and is capable of selectively operating as any one of at least a resonator and a transmission line depending on an on/off state of said one or more switch circuits;

wherein provided that reference character R represents a predetermined integer equal to or greater than 1, and reference character r represents an integer equal to or greater than 1and equal to or smaller than R, the multi-role circuit element further comprises R switches $S_r$, where r =1, 2, . . . , R, and an r-th switch $S_r$ is connected at one end thereof to said first transmission line and to said second transmission line at another end, and an electrical length between the point of connection of said one end of said switch $S_r$ to said first transmission line and said one end of said first transmission line is equal to an electrical length between the point of connection of said another end of said switch $S_r$ to said second transmission line and said one end of said second transmission line.

* * * * *

UNITED STATES PATENT AND TRADEMARK OFFICE

CERTIFICATE OF CORRECTION

PATENT NO. : 8,760,244 B2
APPLICATION NO. : 13/040717
DATED : June 24, 2014
INVENTOR(S) : Kunihiro Kawai et al.

It is certified that error appears in the above-identified patent and that said Letters Patent is hereby corrected as shown below:

Title Page: (73) Assignee: change "NTT DoCoMo" to -- NTT DOCOMO --.

In the Claims

Claim 18, Col. 25, line 48, change "$1 \geq m \leq M/2$" to -- $1 \leq m \leq M/2$ --.

Claim 18, Col. 25, line 52, change "M/2 m M" to -- $M/2 \leq m \leq M$ --.

Signed and Sealed this
Tenth Day of February, 2015

Michelle K. Lee

Michelle K. Lee
*Deputy Director of the United States Patent and Trademark Office*